US009814294B2

(12) United States Patent
Hermouet et al.

(10) Patent No.: US 9,814,294 B2
(45) Date of Patent: Nov. 14, 2017

(54) APPLICATOR DEVICE FOR A PRODUCT IN STICK FORM AND USE OF SAME

(71) Applicant: PARFUMS CHRISTIAN DIOR, Paris (FR)

(72) Inventors: Yannick Hermouet, Saran (FR); Pierre Joulia, Talloires (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 33 days.

(21) Appl. No.: 15/030,336

(22) PCT Filed: Oct. 17, 2014

(86) PCT No.: PCT/FR2014/052647
§ 371 (c)(1),
(2) Date: Apr. 18, 2016

(87) PCT Pub. No.: WO2015/055964
PCT Pub. Date: Apr. 23, 2015

(65) Prior Publication Data

US 2016/0249729 A1 Sep. 1, 2016

(30) Foreign Application Priority Data

Oct. 18, 2013 (FR) ..... 13 60190

(51) Int. Cl.
*A45D 40/06* (2006.01)
*A45D 40/12* (2006.01)
*A45D 40/22* (2006.01)

(52) U.S. Cl.
CPC ..... *A45D 40/065* (2013.01); *A45D 40/22* (2013.01); *A45D 40/12* (2013.01); *A45D 40/221* (2013.01)

(58) Field of Classification Search
CPC combination set(s) only.
See application file for complete search history.

(56) References Cited

U.S. PATENT DOCUMENTS 5,423,622 A * 6/1995 Perrotti ..... A45D 40/065 401/108
5,979,468 A 11/1999 Blake, III
(Continued)

FOREIGN PATENT DOCUMENTS

EP 2298117 A1 3/2011
EP 2409596 A2 1/2012

OTHER PUBLICATIONS

International Search Report Application No. PCT/FR2014/052647; dated Dec. 12, 2014.

*Primary Examiner* — David Walczak
(74) *Attorney, Agent, or Firm* — Miller, Matthias & Hull LLP

(57) ABSTRACT

An applicator device comprising a tubular base, a sleeve mounted rotating on the tubular base between a storage position and a use position, an end cover designed to close the sleeve, a maneuvering mechanism comprising first and second parts rotatably mounted relative to each other, and a cup carrying a stick of product, the first and second parts being driven in rotation respectively with the tubular base and the sleeve and being designed to move the cup axially when the sleeve rotates on the tubular base. The first and second parts of the maneuvering mechanism are mounted axially sliding respectively relative to the tubular base and to the sleeve, and are moved axially in the outlet direction of the stick of product when the sleeve is rotated towards the storage position from an intermediate angular position.

15 Claims, 24 Drawing Sheets

(56) References Cited

U.S. PATENT DOCUMENTS

| | | | | |
|---|---|---|---|---|
| 8,152,398 | B2 | 4/2012 | Kim et al. | |
| 8,591,129 | B2 * | 11/2013 | Chan | A45D 40/22 401/107 |
| 8,622,642 | B2 * | 1/2014 | Kim | A45D 40/065 401/107 |

* cited by examiner

APPLICATOR DEVICE FOR A PRODUCT IN STICK FORM AND USE OF SAME

CROSS-REFERENCE TO RELATED APPLICATION

This Application is a 35 USC §371 US National Stage filing of International Application No. PCT/FR2014/052647 filed on Oct. 17, 2014, and claims priority under the Paris Convention to French Patent Application No. 13 60190 filed on Oct. 18, 2013.

FIELD OF THE DISCLOSURE

Field of the Invention

The present invention relates to applicator devices for products in stick form and to their uses.

Background of the Disclosure

More particularly, the invention relates to an applicator device for a product, comprising:

- a tubular casing extending along a longitudinal axis between first and second ends, the second end being open, said casing being adapted to contain a stick of product and comprising:
  - a tubular base extending along the longitudinal axis,
  - a sleeve mounted so as to rotate freely on the tubular base about the longitudinal axis, between first and second angular positions,
- an end cover means adapted to close the second end of the casing and controlled by relative rotation of the sleeve in relation to the tubular base in order to open when said sleeve is rotated in a first direction of rotation relative to the base and to close when said sleeve is rotated in a second direction of rotation that is opposite to the first direction of rotation relative to the tubular base,
- a maneuvering mechanism having first and second parts mounted so as to rotate relative to one another about the longitudinal axis and a cup carrying the stick of product, the first and second parts being respectively rotatably connected to the tubular base and to the sleeve so as to move the cup axially toward the second end of the casing when said sleeve is rotated in the first direction of rotation relative to the tubular base and toward the first end of the casing when said sleeve is rotated in the second direction of rotation relative to the tubular base.

Document U.S. Pat. No. 8,152,398 describes an example of such an applicator device, intended for lipstick. Such applicator devices allow actuating the applicator device with one hand. They have the disadvantage of requiring significant angular rotation between the tubular base and the sleeve, because the end cover means must be at least partially open before the stick of product can begin to protrude from the casing.

SUMMARY OF THE DISCLOSURE

The present invention is intended to overcome this disadvantage.

To this end, in the invention, a device of the kind in question is characterized in that the first and second parts of the maneuvering mechanism are mounted so as to slide axially relative to the tubular base and to the sleeve respectively, the tubular casing being further connected to one of said first and second parts of the maneuvering mechanism by a guide device (this guide device may connect for example the first part of the maneuvering mechanism to the sleeve, or the second part of the maneuvering mechanism to the tubular base) suitable for:

- moving said first and second parts of the maneuvering mechanism axially toward the second end of the casing when the sleeve is rotated in the first direction of rotation relative to the tubular base from an intermediate angular position between said first and second angular positions,
- moving said first and second parts of the maneuvering mechanism axially toward the first end of the casing when said sleeve is rotated in the second direction of rotation relative to the tubular base between the second angular position and the intermediate angular position,
- and not moving said first and second parts of the maneuvering mechanism axially toward the first end of the casing when said sleeve is in an angular position between the first angular position and the intermediate angular position.

With these arrangements, the sliding of the stick of product toward the second end is delayed when the end cover means begins to open, then this sliding is accelerated once the end cover means is sufficiently open, which allows the applicator device to travel to the usage position over a reduced path of angular actuation.

In various embodiments of the applicator device of the invention, one or more of the following arrangements may possibly be used:

- the first and second parts of the maneuvering mechanism are connected so as to be integral in axial translation, the guide device comprises at least one linear guide arranged on a cylindrical surface of revolution centered on the longitudinal axis and at least one follower member sliding along the linear guide, the linear guide and follower member being integrally connected, one to a first element selected from among the first and second parts of the maneuvering mechanism, the other to a second element selected from among the tubular base and the sleeve, the first and second elements not being mounted so as to slide axially relative to one another (in other words, if the first element is the first part of the maneuvering mechanism, then the second element is the sleeve, and if the first element is the second part of the maneuvering mechanism, then the second element is the tubular base);

- the linear guide comprises a circular portion comprised within a radial plane and a helical portion, the follower member being located on the circular portion when the sleeve is between the first angular position and the intermediate angular position, and on the helical portion when the sleeve is between the intermediate angular position and the second angular position;
- said first element is the second part of the maneuvering mechanism and said second element is the tubular base;
- the first and second parts of the maneuvering device are rotatably connected respectively to the tubular base and to the sleeve;
- the maneuvering mechanism further comprises delaying means for delaying an axial sliding of the cup when the sleeve is moved in the first direction of rotation from the first angular position;
- the first part of the maneuvering mechanism is an inner sheath having at least one slot comprising an axial portion extending between first and second ends respectively located towards the first and second ends of the tubular casing, the slot further comprising an end portion comprised substantially in a radial plane and extending the axial portion in the second direction of rotation at the first end of said axial portion, the second part of the maneuvering mechanism is an outer sheath surrounding the inner sheath and comprising at least one internal helical groove, and the cup comprises at least one pin engaged in both said slot of the inner sheath and said internal groove of the outer sheath, said pin of the cup being in the end portion when the sleeve is in the first angular position;

the end cover means comprises a ring housed in the tubular casing, rotatably connected to the sleeve and sliding axially relative to said sleeve, this ring threadably engaging with the tubular base and bearing at least one flap adapted to close the second end of the tubular casing when the sleeve is in the first angular position;

the ring bears at least two flexible flaps that are deformable between a planar configuration which closes the second end of the tubular casing and a cylindrical configuration which opens the second end of the tubular casing, the sleeve comprising an inner annular flange at the second end of the tubular casing and the flaps being maintained in a planar configuration by abutment under the inner flange of the sleeve when the sleeve is in the first angular position, the ring being arranged around the maneuvering mechanism and the flaps being held in the cylindrical configuration by cooperation with the tubular casing and maneuvering mechanism when the applicator device is opened;

the sleeve further comprises inner guides and the flaps abut against said inner guides when said flaps are in a planar configuration;

the flaps are two in number and are in the form of half-disks each comprising a semicircular edge and a straight edge, the semicircular edges being connected to the ring by respective hinges that are diametrically opposed relative to the longitudinal axis, the inner guides each having a guiding edge facing the second end of the tubular casing, each guiding edge having the shape of half a pointed arch having its peak substantially midway between the hinges;

the ring is connected to the tubular base by a guide device suitable for moving said ring axially when the sleeve is close to the first angular position and not moving said ring axially when the sleeve is close to the second angular position;

the sleeve is retractable into the tubular base;

the tubular base comprises an outer shell, a support socket fixed in the outer shell, and a sheath on which the sleeve is rotatably mounted, the sheath being mounted so as to slide axially on the support socket between a retracted position where the sleeve is wholly contained in the outer shell, a deployed position where the sleeve protrudes from the outer shell, and an actuation position where the sleeve is pressed into the outer shell toward the first end of the tubular casing relative to the retracted position, the sheath being resiliently biased toward the deployed position and the tubular base having a cam locking device suitable for:

snap-locking the sheath in the retracted position when a user moves said sheath from the deployed position to the retracted position by pressing on the sleeve, and releasing said sheath when a user moves said sheath from the retracted position to the actuation position by pressing on the sleeve.

The invention also relates to a use of an applicator device as defined above for the application of cosmetic products, particularly lipstick.

BRIEF DESCRIPTION OF DRAWINGS

Other features and advantages of the invention will be apparent from the following description of two of its embodiments, given by way of non-limiting examples, with reference to the accompanying drawings.

In the drawings.

DETAILED DESCRIPTION OF THE DISCLOSURE

In the various figures, the same references designate identical or similar elements.

A. First Embodiment of the Invention

As can be seen in FIGS. 1, 2, 3, 3A, 4, 4A, the applicator device 1 comprises a tubular casing 2 which extends along a longitudinal direction X between first and second ends 2*a*, 2*b*, respectively the lower and upper ends in the current usage position of the applicator device (in the following, the terms "lower" and "upper" will be used with reference to this current usage position of the applicator device). More specifically, the tubular casing 2 may have a general cylindrical shape centered on a longitudinal axis X. The second end 2*b* is open.

Figure 7:
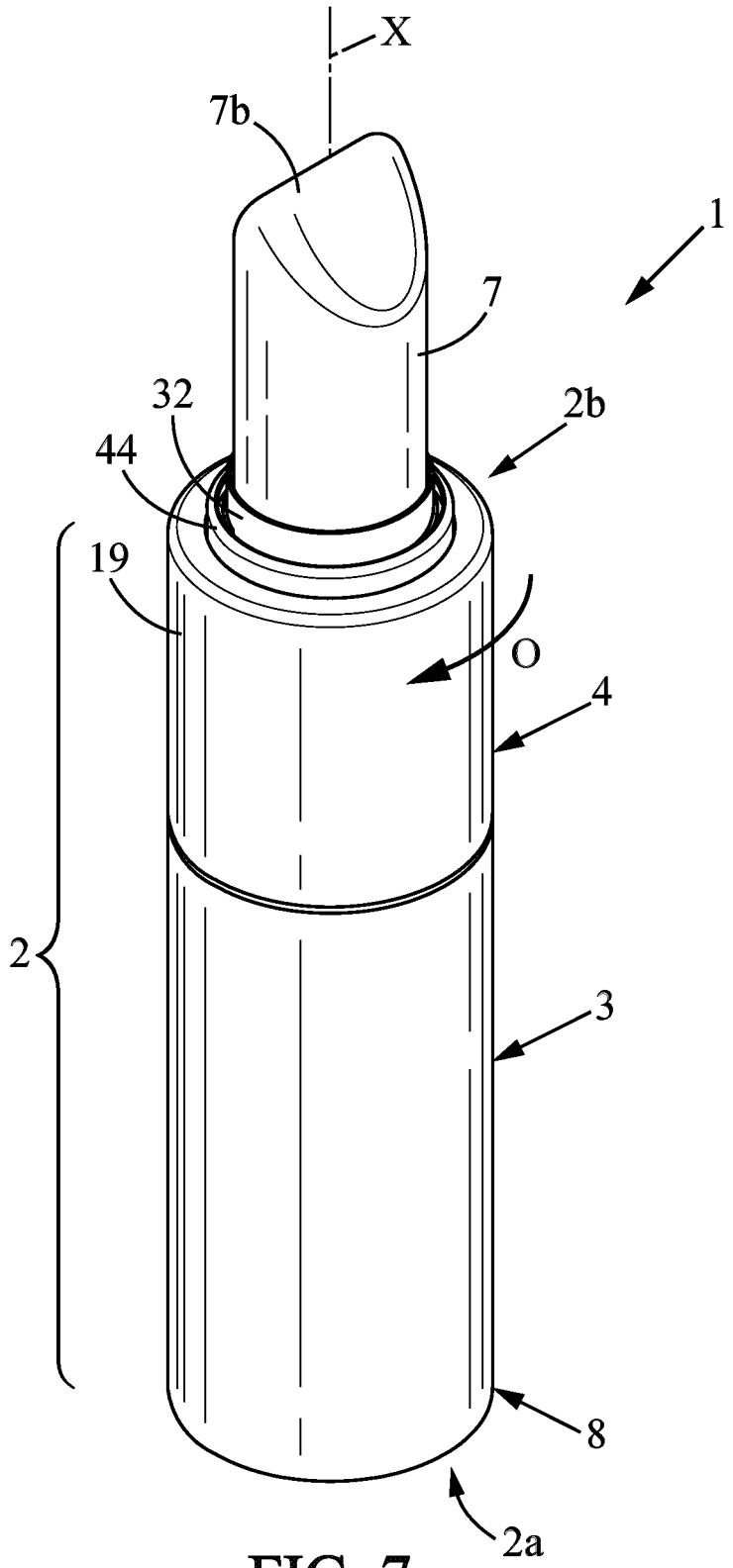
FIGS. 7 and 8 are views respectively similar to FIGS. 1 and 2, showing the applicator device of FIG. 1 in a usage position, the stick of product being extended.

The tubular casing 2 comprises a tubular base 3 extending along the longitudinal axis X and a sleeve 4 mounted so as to rotate freely on the tubular base 3 about the longitudinal axis X, between first and second angular positions respectively corresponding to the storage position (FIG. 1) and to the usage position (FIG. 7).

In the storage position, the second end 2*b* of the casing is closed by an end cover 5 that will be detailed below.

In addition, the tubular casing 2 further contains a maneuvering mechanism 6 which makes it possible to retract or extend a stick of product 7 into or from the second end 2*b* of the tubular casing, as will be explained in more detail below. The stick of product 7 may be, for example, a solid or pasty product for cosmetic or pharmaceutical use. It may be a product for the lips, for example lipstick.

The sleeve 4 is manually actuated by rotating it in a first direction of rotation O from its first angular position relative to the tubular base 3, to cause the stick of product 7 to extend from the casing 2 at said second end 2*b*, and in a second direction of rotation F opposite the first direction from its second angular position to cause the stick of product 7 to retract into the casing 1.

Tubular Base 3

The tubular base 3 may, for example, be made of two parts:

optionally, an outer shell 8 of metal or other material, essentially decorative, comprising a tubular side wall 8*a* centered on the longitudinal axis X (for example a surface of revolution about the longitudinal axis X) and open towards the second end 2*b* of the tubular casing, and a bottom 8*b* at the first end 2*a* of the tubular casing 2, and a lower sheath 9 made for example of molded plastic and secured to the outer shell 8, for example by force-fitting or the like.

The lower sheath 9 has:

a tubular side wall 9*a* centered on the longitudinal axis X (for example a surface of revolution about the longitudinal axis X), fitted into the side wall 8*a* of the shell and open towards the second end 2*b* of the casing 2, and a bottom 9*b*.

In the example considered here, the side wall 9*a* of the lower sheath 9 may have a thick lower portion 10 extending from the bottom 9*b* to an external annular shoulder 11 facing the first end 2*a* of the casing, and a thinner upper portion 12 extending from the bottom 9*b* to the open upper end of the lower sheath 9. This upper portion 12 may comprise an external annular bead 13 near the external shoulder 11, and at least one external pin 14 (here two external diametrically opposite pins 14) adjacent to the open upper end of the side wall 9*b*.

The lower sheath 9 may also comprise an internal annular shoulder 15, formed in the lower portion 10 of the lower sheath and facing the second end 2*b* of the casing, and at least one internal helical thread 16 formed in the second portion 12, advantageously two diametrically opposed internal helical threads 16. The helical threads 16 spiral upward in the first direction of rotation O, each between a lower end and an upper end.

The lower sheath 9 may further comprise:

at least one axial slot 17 formed in the lower portion 10 parallel to the longitudinal axis X, extending for example from the bottom 9*b* to near the external annular shoulder 11 (for example two diametrically opposed axial slots 17 in the example considered), and least one arcuate radial slot 18, generally opening at one end, formed in the lower portion 10 immediately adjacent to the external shoulder 11 (for example two diametrically opposed slots 18 arranged in the same radial plane, as in the example). Each of the slots 18 extends angularly between a first end 18*a* and second end 18*b* in the first direction of rotation O, the second angular ends 18*b* of the radial slots 18 respectively opening into the lower ends of the abovementioned threads 16.

Sleeve 4

As for the sleeve 4, it may for example be made of two parts:

optionally, an outer shell 19 of metal or other material, having a tubular side wall 19*a* centered on the longitudinal axis X (for example a surface of revolution about the longitudinal axis X) and open towards the first end 2*a* of the tubular casing, and an inner annular flange 19*b* at the second end 2*b* of the tubular casing 2, and an upper annular body 20 made for example of molded plastic and secured to the outer shell 19, for example by force-fitting or the like.

The upper annular body 20 is centered on the longitudinal axis X and advantageously forms a surface of revolution about this axis. It extends along the axis X between a lower end 20*a* fixed to the lower sheath 9, and an upper end 20*b* positioned under the flange 19*b* of the shell 19.

The upper annular body 20 may have an external annular rib 21 arranged radially relative to the longitudinal axis X, this rib being flush with the outer surface of the shells 8, 19 at their facing ends (upper end of shell 8 and lower end of shell 19).

The upper annular body 20 further comprises at least one axial slot 22 extending along the longitudinal axis X and said slot being open at the upper end 20*b* of the upper annular body. Advantageously, the upper annular body 20 comprises two diametrically opposed axial slots 22. At the upper end 20*b* of the upper annular body 20 there may be guides 23 formed in relief inside the upper annular body 20, on either side of each slot 22. The respective guides 23 have rounded upper guiding edges 23*a*, each in the form of half a pointed arch, the upper guiding edges 23*a* extending downward (meaning toward the first end 2*a*) and away from the corresponding slot 22.

The upper annular body 20 further comprises an internal annular groove 24, extending in a radial plane, at its lower end 20*a*. The external annular bead 13 of the lower sheath 9 snap-fits into this internal annular groove 24, so that the upper annular body 20 and the lower sheath 9 are connected so as to be integral in axial translation while allowing relative rotation between these two components about the longitudinal axis X.

The upper annular body 20 further comprises at least one internal guide groove 20*c* (FIG. 4A) extending along the axis X from the lower end 20*a* to just below one of the guides 23, its usefulness to be discussed below. Advantageously, the grooves 20*c* are two in number and are diametrically opposed.

End Cover 5

The abovementioned end cover 5 may be molded for example at least partially of flexible synthetic material and comprises a tubular side wall 5*a*, for example a cylindrical shape centered on the longitudinal axis X, which is mounted to slide axially along the longitudinal axis X inside the upper annular body 20.

The side wall 5*a* of the end cover extends between a lower edge 5*b* located towards the lower end 20*a* of the upper annular body 20, and an upper edge 5*c* located towards the upper end 20*b* of the upper annular body 20.

The upper edge 5*c* is upwardly extended by two diametrically opposite arms 25, with flexible flaps 26 substantially in the form of half discs being mounted at the upper ends thereof. Each flap 26 comprises a semi-circular edge 26*a* which is connected to the corresponding arm 25 by a hinge 27, and a straight edge 26*b*.

Figure 1:
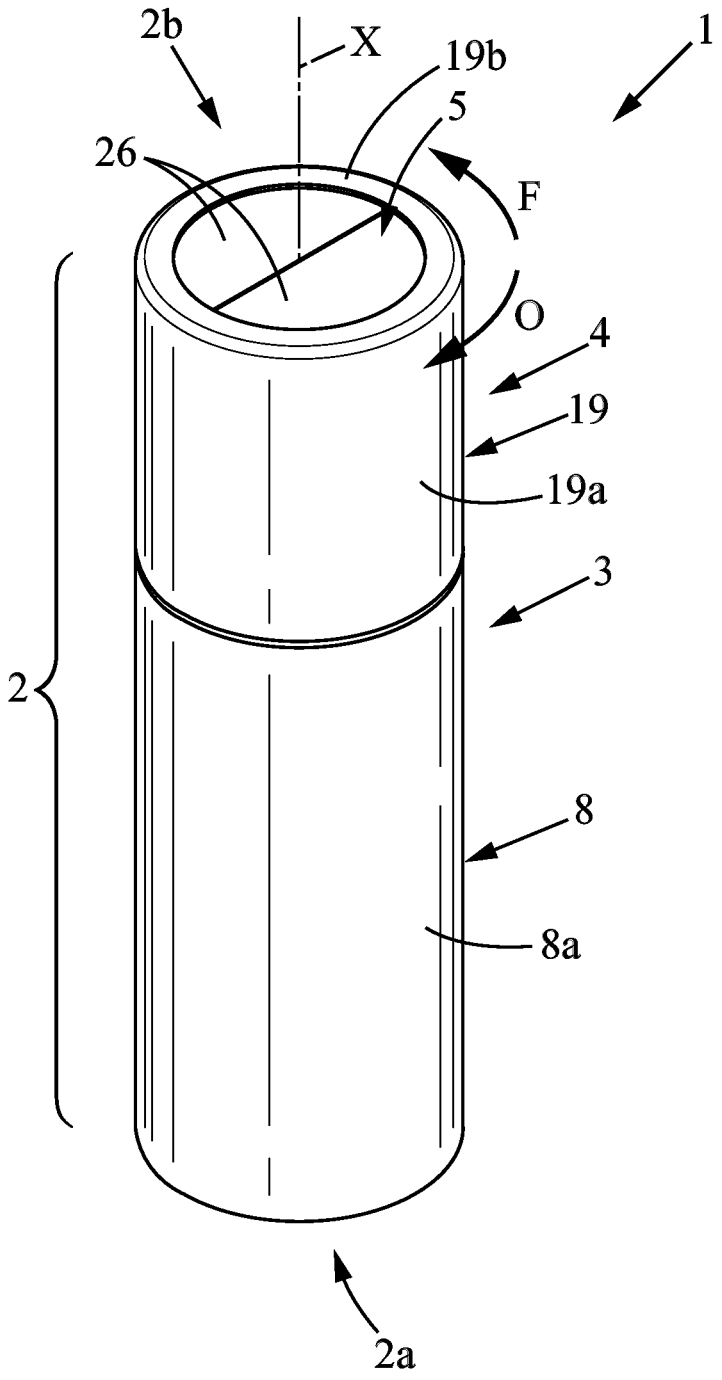
FIG. 1 is a general perspective view of an applicator device according to a first embodiment of the invention, in the storage position.

When the applicator device 1 is in the storage position of FIG. 1, the flaps 26 are flat and lie under the flange 19*b* of the shell 19, the straight edges 26*b* of the flaps being in mutual contact and the ends of said straight edges 26*b* resting on the upper ends of the guiding edges 23*a* of the guides 23. The flaps 26 may be parts that are distinct from the side wall 5*a* of the end cover 5, molded separately and linked to the arms 25 of said end cover by means of pivots forming the hinges 27, as in the example shown (in this case, the side wall 5*a* of the end cover can be molded of more rigid plastic and the flaps 26 can be molded of a more flexible synthetic material, for example silicone rubber). Alternatively, the flaps 26 could be formed integrally with the rest of the end cover 5, the hinges 27 then simply being flexible areas, for example thinned areas. The flaps 26 may also comprise a relatively rigid portion (for example a metal blade) overmolded with plastic material which also forms the hinge.

The end cover 5 may also be or comprise a metal blade of very thin sheetmetal.

The end cover 5 may further comprise, in the example considered:

- at least one guide rib 28 and preferably two diametrically opposed guide ribs 28, extending along the longitudinal axis X on the exterior of the side wall 5*a* between the lower 5*b* and upper 5*c* edges, between the arms 25,
- at least one axial through-slot 29, and preferably two diametrically opposed axial slots 29, formed in the side wall 5*a* for a certain distance from the upper edge of said side wall 5*c*, also between the arms 25,
- at least one radial slot 30 and preferably two diametrically opposed radial slots 30, generally through-slots, each of said radial slots extending angularly between first and second ends 30*a*, 30*b* in the abovementioned direction of rotation O,
- at least one two internal helical threads 31 and preferably two diametrically opposed internal helical threads 31, spiraling towards the lower end 5*b* in the direction of rotation O, respectively from the second ends 30*b* of the radial slots 30.

Each guide rib 28 is received in one of the guide grooves 20*c* of the upper annular body 20, so that the end cover is rotatably connected to said upper annular body while being axially slidable relative thereto. In the storage position, the end cover is in the raised position relative to the upper annular body 20, the upper edge 5*c* of the end cover being located under the guides 23 and immediately adjacent thereto and the arms 25 of the end cover being located between the pairs of guides 23.

Each of the helical threads 31 of the end cover receives one of the abovementioned pins 14 of the lower sheath 9, these pins 14 being near the lower end 5*b* in the storage position of the applicator device. Note that if the lower sheath 9 has only one pin 14, it is possible for the end cover to have only one thread 31 and one radial slot 30. In the storage position, the pins 14 are each located at the lower end of the corresponding thread 31.

Maneuvering Mechanism 6

The maneuvering mechanism 6 may be of any known type. In the example concerned, the maneuvering mechanism 6 comprises a cup 32 generally of molded plastic, containing the proximal end 7*a* of the stick of product 7. Said stick of product 7 extends axially along the longitudinal axis X from this proximal end 7*a* to a distal end 7*b* which may for example be a beveled end and which, in the storage position of the applicator device, is located inside the tubular casing 2 and is protected by the flaps 26 of the end cover.

The cup 32 has a bottom 32*a*, an annular side wall 32*b*, and two diametrically opposed lateral pins 33 projecting radially outward from the side wall 32*b*.

The cup is controlled by rotation of the sleeve 4 relative to the tubular base 3 so that it slides toward the second end 2*b* of the casing when said sleeve 4 rotates in the first direction of rotation O and slides toward the first end 2*a* of the casing when the sleeve 4 is rotated in the second direction of rotation F, for example using two concentric sheaths 34, 40, respectively internal and external, both engaging with the pins 33.

The inner sheath 34 is typically a molded plastic part having a cylindrical shape centered on the longitudinal axis X, which extends between a lower end 34*a* and an upper end 34*b*. In the example considered here, the lower end is provided with two diametrically opposite tabs 36, projecting outward and engaged in the axial slots 17 of the lower sheath 9 so that the inner sheath 34 can slide axially relative to the tubular base 9 while remaining rotatably connected therewith. In the storage position of the applicator device, advantageously, the tabs 36 may be supported by resilient axial fingers 35 formed in the lower portion of the inner sheath 34 and defined by axial slots 35*a* formed in the inner sheath 34 and opening onto the lower end 34*a* of said inner sheath 34. Furthermore, the tabs 36 may include a cam face 36*a* facing obliquely downwards and outwards, and a stop face 36*b* lying substantially in a radial plane and facing upward. Thus, the inner sleeve 34 can be engaged in the tubular base 9 by simple axial engagement that snap-fits the tabs 35 into the slots 17.

In the storage position of the applicator device 1, the tabs 36 are at the lower end of the slots 17, the lower end 34*a* of the inner sheath 34 bearing against the bottom 9*b* of the lower sheath 9.

Moreover, the inner sheath 34 may have an external lower annular bead 37 and an external upper annular bead 38 whose usefulness will be seen below, and a slot 39 having an axial portion 39*a* extending parallel to the longitudinal axis X between end sections, respectively the lower end 39*b* and upper end 39*c*, which extend angularly in radial planes, respectively in the second direction of rotation F to an end 39*b*1 for the lower end portion 39*b* and in the first direction of rotation O to an end 39*c*1 for the upper end portion 39*c*.

As for the outer sheath 40, it is also generally a molded plastic part forming a cylinder centered on the longitudinal axis, extending between a lower end 40*a* and an upper end 40*b*. Said inner sheath 34 is snap-fitted axially into the outer sheath 40 and is axially retained therein by the abovementioned beads 37, 38 which engage by abutment respectively with an internal shoulder 40*c* and with the upper end of the outer sheath 40 in the example considered (see FIG. 2). The sheaths 34, 40 can thus rotate relative to one another about the axis X.

The outer sheath 40 internally comprises two diametrically opposed internal helical threads 41. Each pin 33 of the cup 32 enters one of the threads 41 by traversing one of the slots 39 of the inner sheath 34. In the storage position, the pins 33 of the cup are at end 39*b*1 of the lower portion of the slot 39 and are at the lower end of the threads 41 of the outer sheath 40.

In addition, the outer sheath 40 externally comprises two diametrically opposed upper pins 43, protruding radially outward near the upper end 40*b* of said outer sheath 40, and two diametrically opposed lower pins 42 projecting radially outward toward the lower end 40*a* of said outer sheath. The upper pins 43 are engaged both in the axial slots 22 of the upper annular body 20 and in the axial slots 29 of the end cover 5, securing the sleeve 4 so that it is rotatably connected to said outer sheath 40 of the maneuvering mechanism 6. In the storage position, the upper pins 43 are in the lower portion of the axial slots 22 of the upper annular body 20 and in the upper portion of the axial slots 29 of the end cover 5.

The outer sheath 40 is fitted into the lower sheath 9 so as to allow relative rotation between the outer sheath 40 and the lower sheath 9, the lower pins 42 of the outer sheath of the maneuvering mechanism being engaged in the radial slots 18 of the lower sheath 9, at the first ends 18*a* of these slots in the storage position.

It is possible for the outer sheath 40 to bear a decorative shell 44, for example of metal, fitted onto the upper end 40*b* of the outer sheath 40, this shell 44 possibly being provided with an upper flange 44*a* and with axial slots 44*b* that are open at the bottom and can receive the abovementioned pins 43.

Operation

The applicator device 1 which has just been described operates as follows.

When a user rotates the sleeve 4 relative to the tubular base 3 in the first direction of rotation O, from the storage position, actuation occurs in two phases of rotation.

Figure 2:
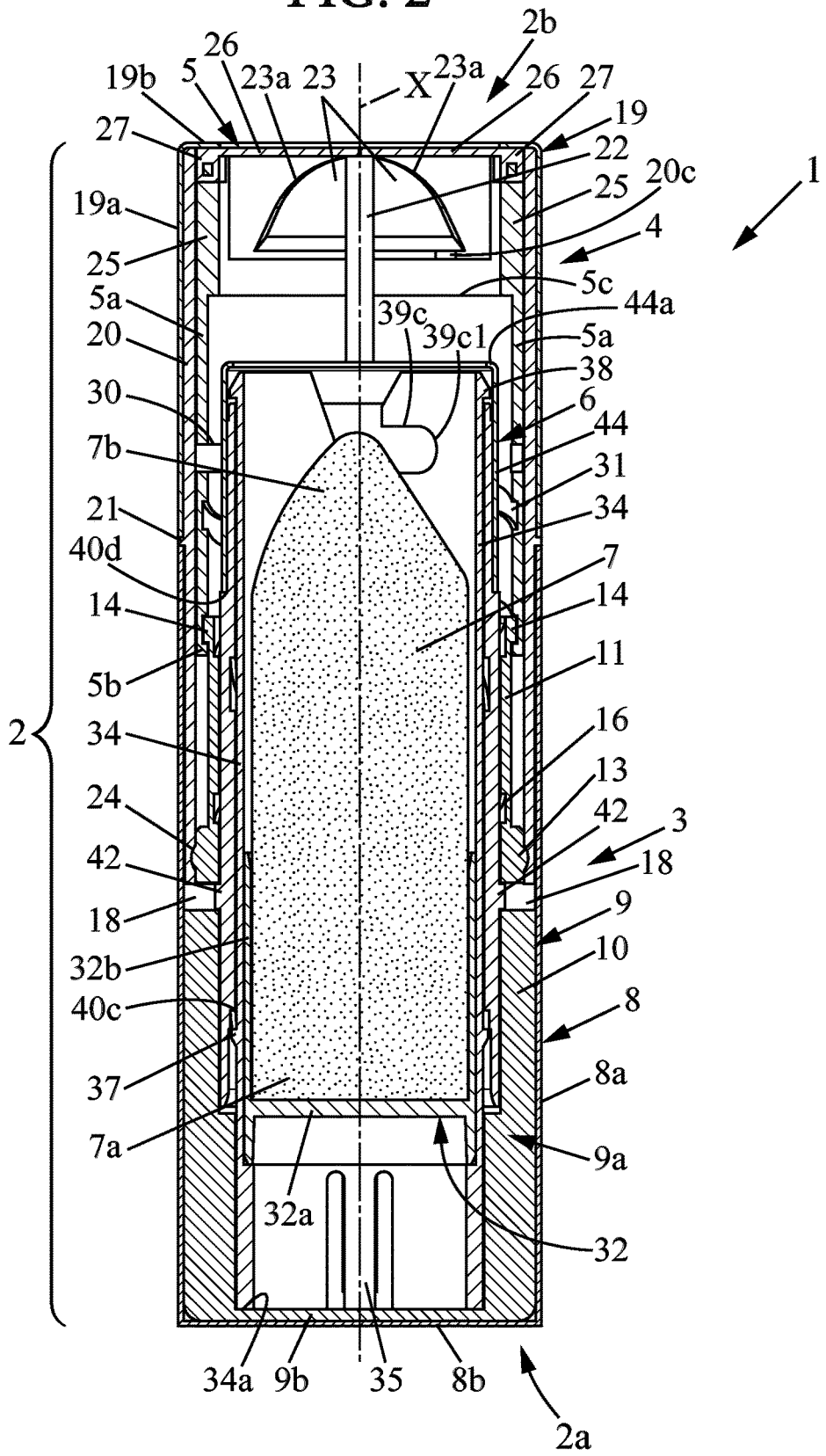
FIG. 2 is an axial sectional view of the applicator device of FIG. 1.
Figure 3A:
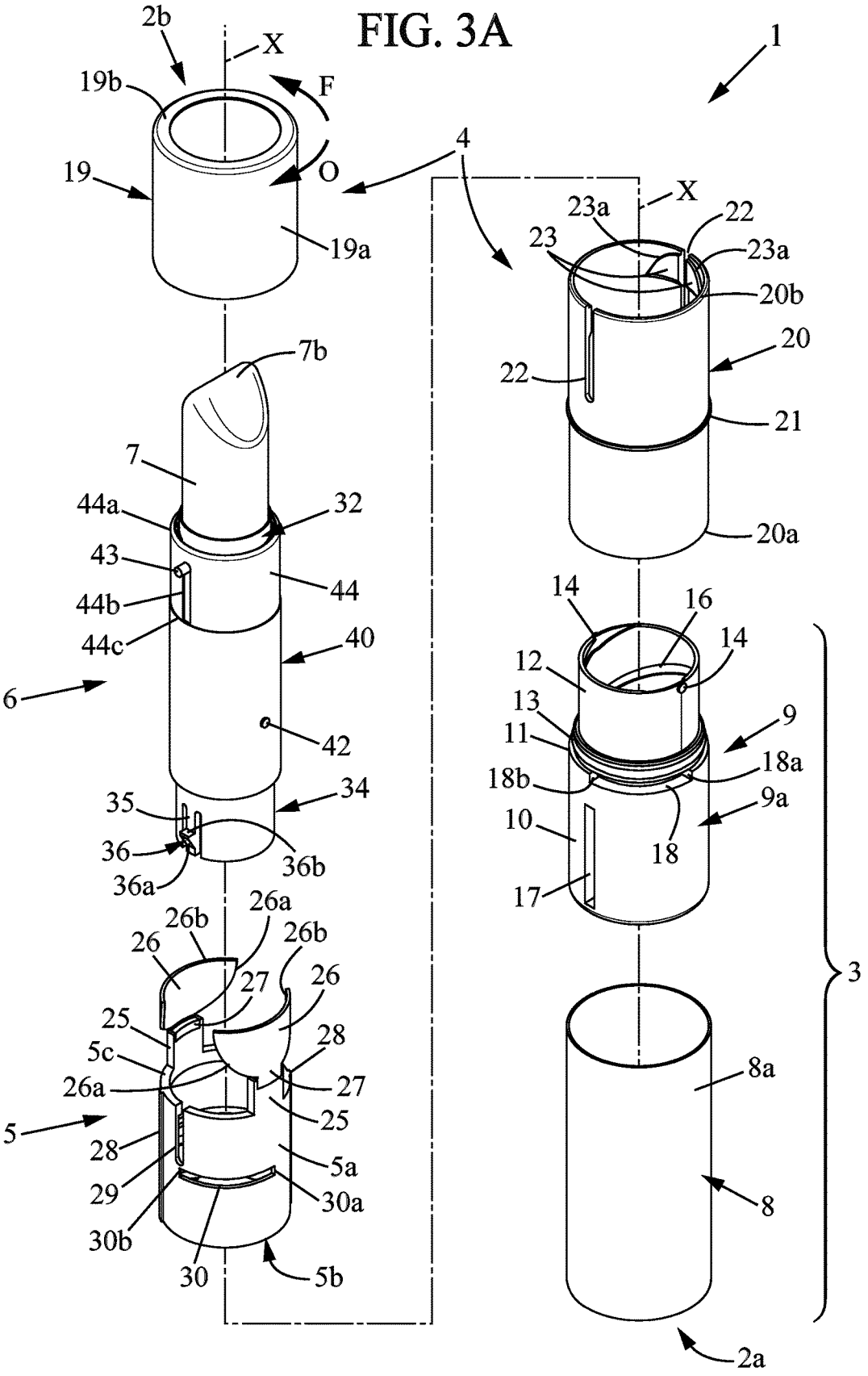
FIG. 3A is an exploded view of the applicator device of FIG. 1, the maneuvering mechanism of the stick of product not being exploded.
Figure 3B:
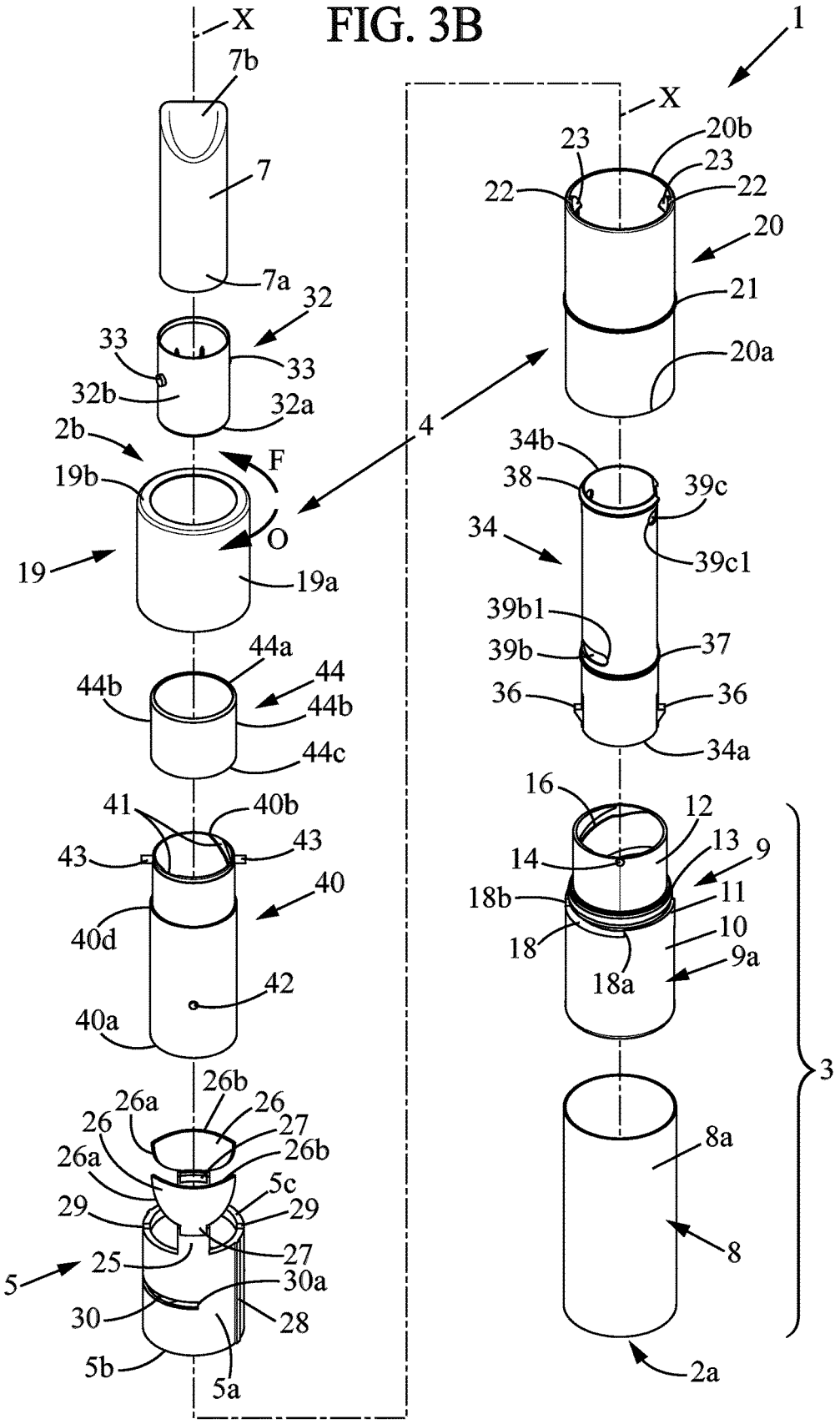
FIG. 3B is an exploded view of the applicator device of FIG. 1, the maneuvering mechanism in this case being in exploded view and the device being viewed from a different angle than in FIG. 3A.
Figure 3C:
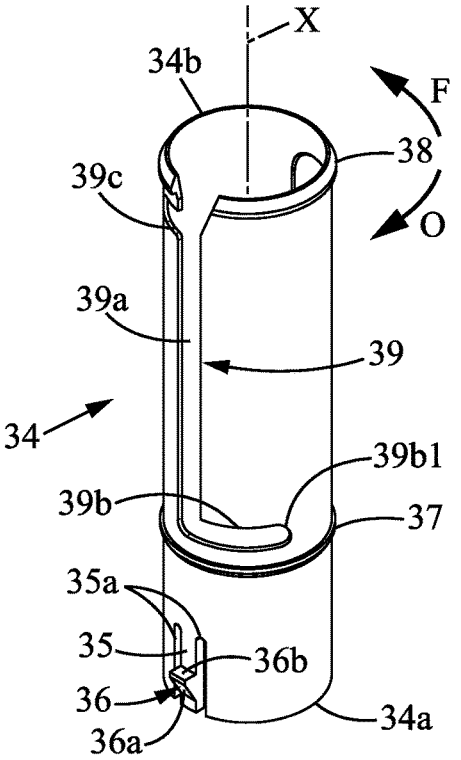
FIG. 3C is a perspective detail view of an inner sheath that is part of the maneuvering mechanism.
Figure 4:
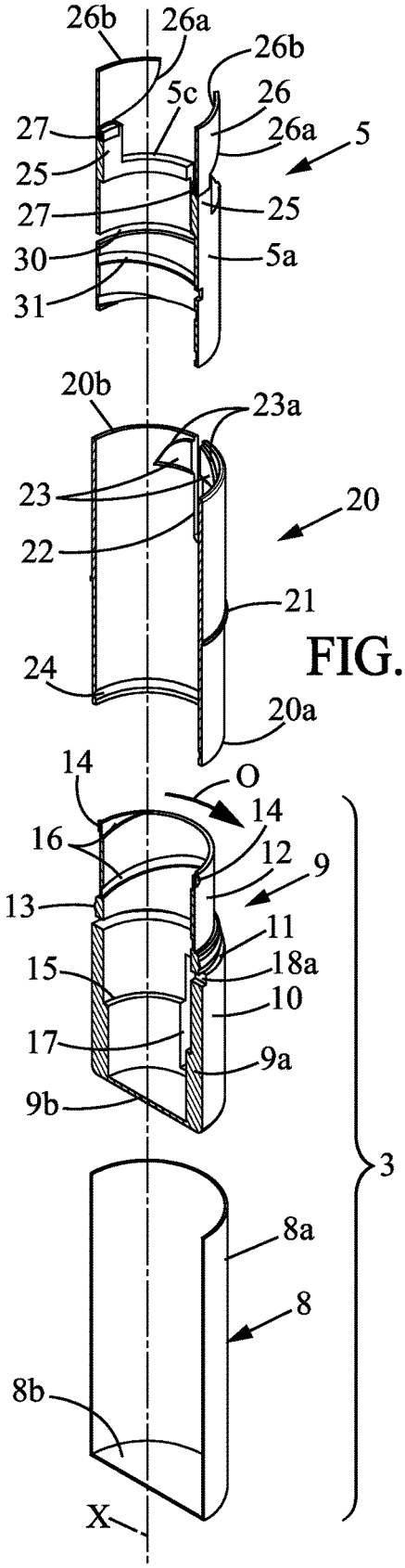
FIG. 4 is an exploded axial sectional view of a portion of the applicator device of FIG. 1, viewed from substantially the same angle as in FIG. 3A.
Figure 4A:
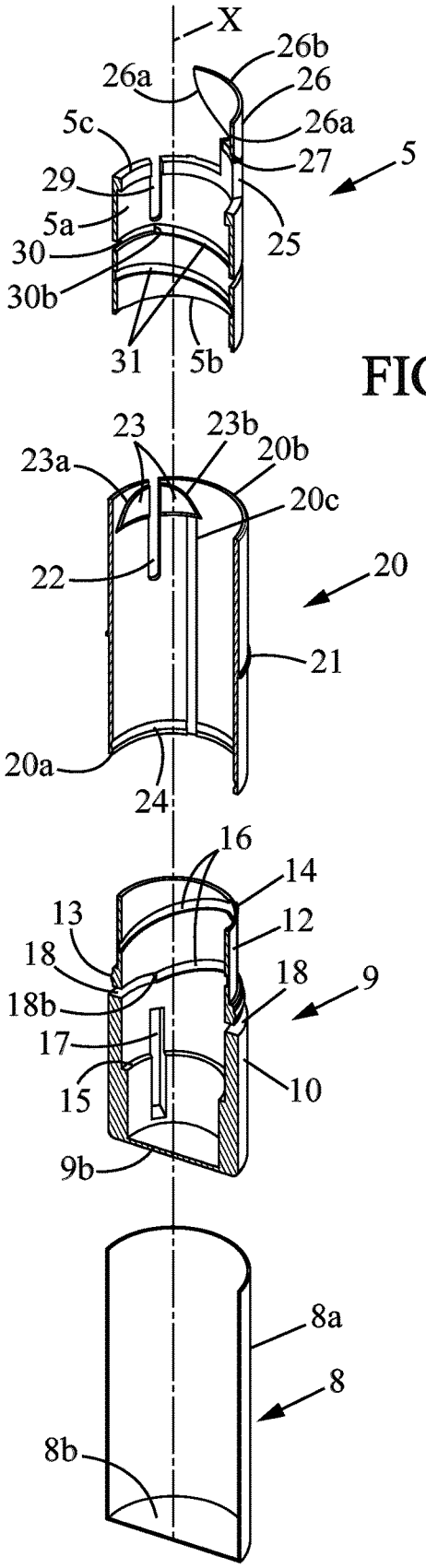
FIG. 4A is an axial sectional view similar to FIG. 4 but with a different sectional plane than in FIG. 4, FIGS. 5 and 6 are views respectively similar to FIGS. 1 and 2, showing the applicator device of FIG. 1 with the end cover in the open position, the stick of product being retracted.
Figure 5:
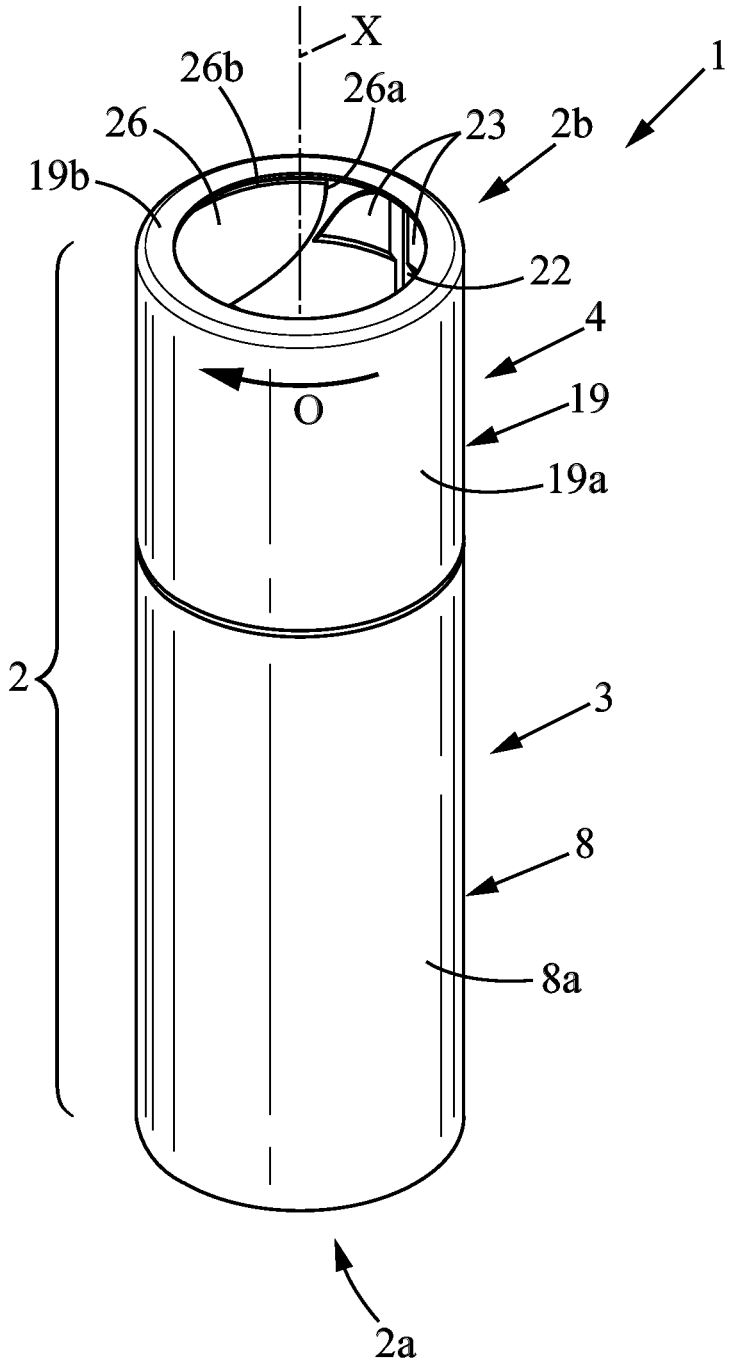
Figure 6:
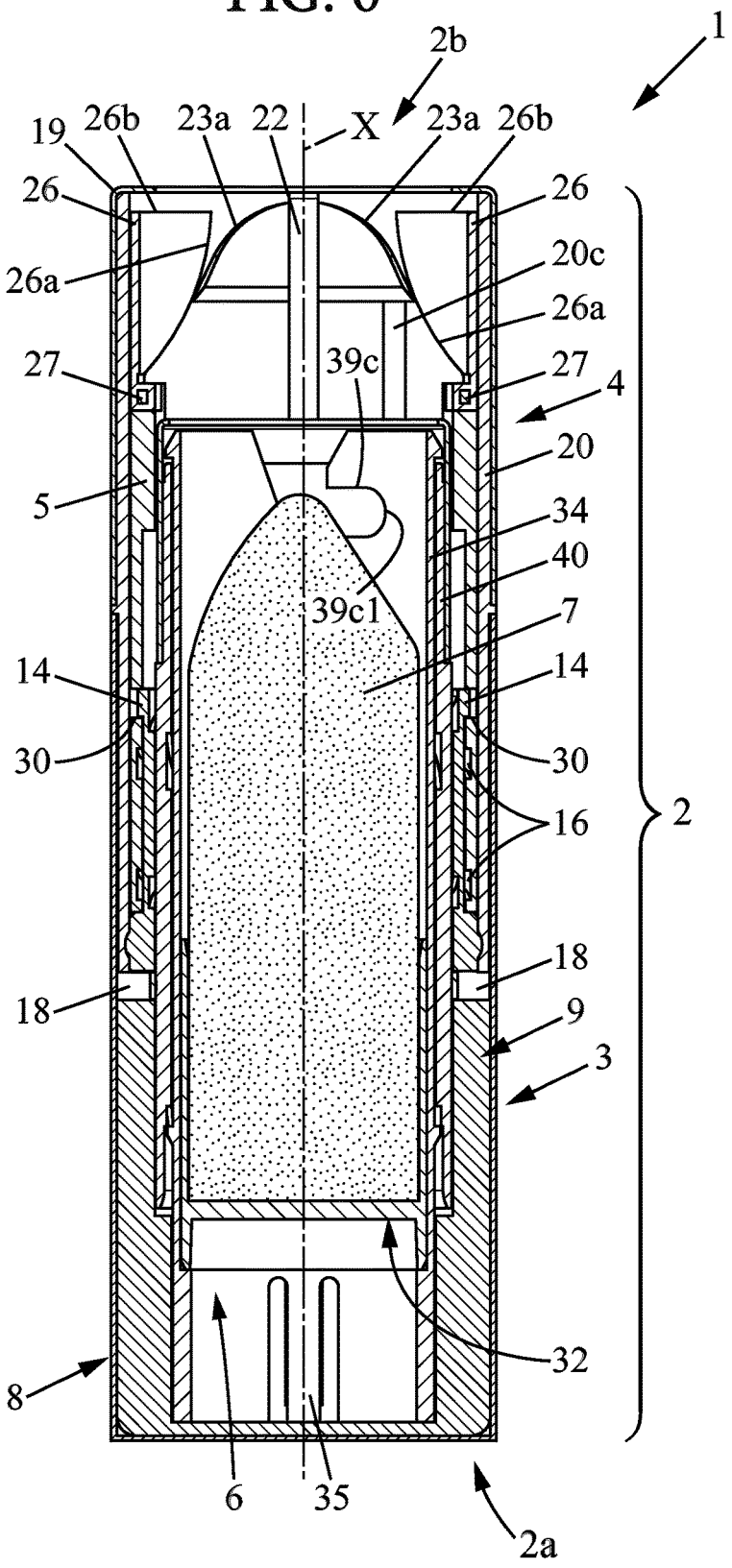

In a first actuation phase, the applicator device moves from the storage position of FIGS. 1 and 2 to the position where the end cover is open as shown in FIGS. 5 and 6.

During this movement, the end cover 5 and the outer sheath 40 of the maneuvering mechanism 6 rotate with the sleeve 4 in the first direction of rotation O, respectively due to the engagement of the guide ribs 28 of the end cover in the grooves 20*c* of the upper annular body 20 and due to the engagement of the upper pins 43 of the outer sheath 40 in the slots 22 of the upper annular body 20. Similarly, the cup 32 rotates with the outer sheath 40 in the direction of rotation O, due to the engagement of the pins 33 of the cup in the threads 41 of the outer sheath.

At the same time, the inner sheath 34 remains rotatably connected to the tubular base 3 due to the tabs 36, as explained above, and the pins 33 of the cup are moved circumferentially in the first direction of rotation O from the end 39*b*1 of the lower end section 39*b* of the slot 39, to the lower end of the axial portion 39*a*. The cup 32 therefore remains in the lowered position in the inner sheath 34.

In the same movement, the lower pins 42 of the outer sheath 40 of the maneuvering mechanism 6 initially rotate in the slots 18, from the first end 18*a* to the second end 18*b*, so that the maneuvering mechanism 6 remains in the lowered position as if still in the storage position.

However, the threads 31 of the end cover 5 rotate in the first direction of rotation O relative to the pins 14 of the lower sheath 9, so that the end cover 5 is moved axially downward relative to the upper annular body 20 due to the screwing effect. During this movement, the circular edges 26*a* of the flaps 26 of the end cover are guided on the upper guiding edges 23*a* of the guides 23, such that the flaps 26 are opened by deformation because of their flexibility, to adopt a cylindrical shape as they press against the inner surface of the upper annular body 20. During this same movement, the axial slots 29 of the end cover engage the pins 43 of the outer sheath 40.

Note that in this first actuation phase, the maneuvering mechanism 6 may be designed to begin raising the stick 7 of product before the flaps 26 are in the fully open position and/or the slots 18 of the tubular base 9 may be arranged to begin raising the maneuvering mechanism 6 before the flaps 26 are in the fully open position. In all cases there is sufficient delay in the raising of the maneuvering mechanism 6 and the stick of product 7 (here due to the portion 39*b* of slots 39 and the slots 18) for the stick of product 7 and maneuvering mechanism 6 not to interfere with the flaps 26 during the second actuation phase.

Figure 8:
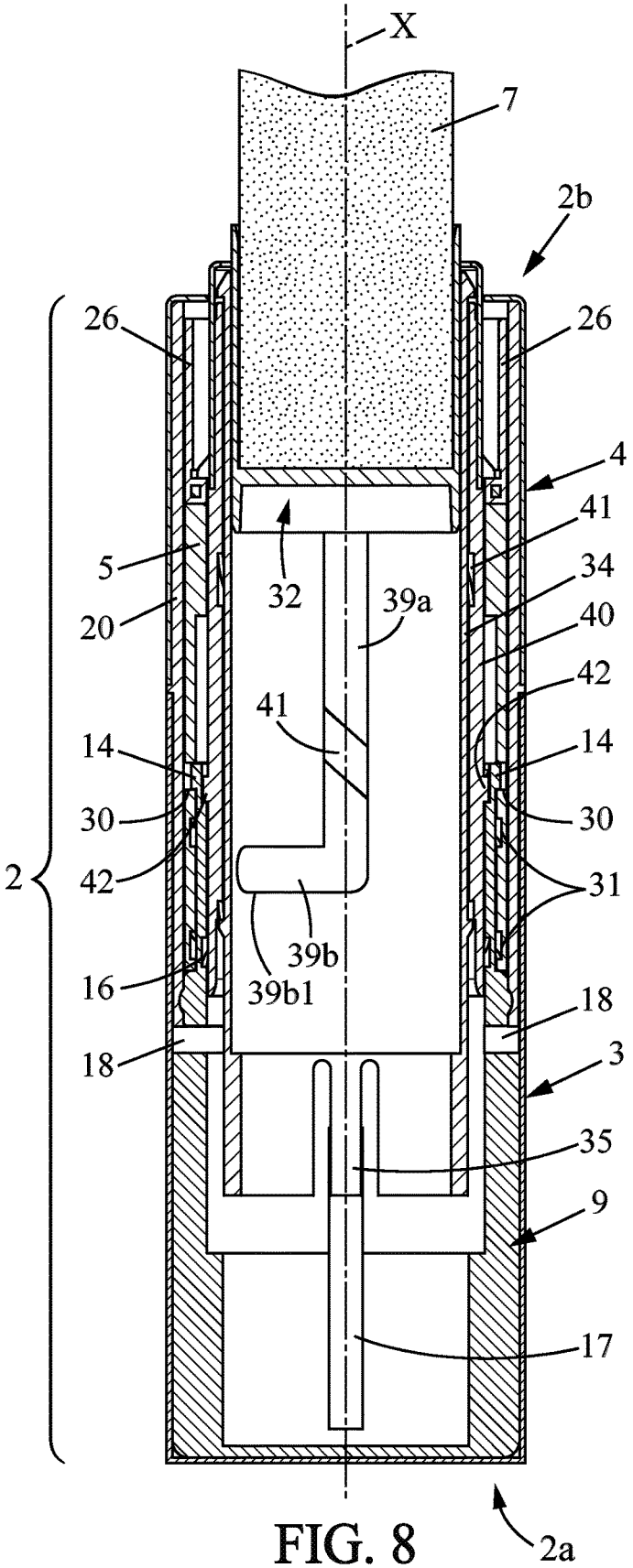

In a second actuation phase, while continuing rotation of the sleeve 4 relative to the base 3 in the first direction of rotation O, the applicator device moves from the open position of the end cover as shown in FIGS. 5 and 6 to the usage position shown in FIGS. 7 and 8.

In this second actuation phase, the end cover 5 and the outer sheath 40 of the maneuvering mechanism 6 continue to rotate with the sleeve 4 in the first direction of rotation O while the inner sheath 34 remains rotatably connected to the tubular base 3.

The pins 33 of the cup then move vertically upwards in the axial portion 39*a* of slot 39, due to the screwing effect from the threads 41 of the outer sheath 40, in a known manner, so that the cup 32 rises with the stick of product 7 in the inner sleeve 34, until it reaches the upper end portion 39*c*.

In the same movement, the lower pins 42 of the outer sheath 40 of the maneuvering mechanism 6 penetrate the threads 16 of the lower sheath 9 and rotate in the first direction of rotation O, so that the maneuvering mechanism 6 moves axially upward until the upper end 34*b*, 40*b* of the inner and outer sheaths 34, 40 is flush with or slightly beyond the upper end 20*b* of the upper annular body 20. This thus permits significant axial movement of the stick of product 7 with a relatively small angular travel during this second phase of operation of this However, during this movement in the second actuation phase, the rotation of the end cover 5 in the first direction of rotation O causes the radial slots 30 of the end cover to engage the pins 14 of the lower sheath 9, so that the end cover 5 no longer moves axially downward relative to the upper annular body 20.

Once the applicator device is in the usage position, the stick of product protrudes from the sheath 2 and can be used to apply the product for example on the lips of a user.

Note that the applicator device 1 can be used to apply product even when the stick of product 7 has not been moved all the way upward, provided that this stick of product extends at least partially from the second end 2*b* of the tubular casing 2.

After use, the applicator device 1 can be returned to the storage position by rotating the sleeve 4 relative to the tubular base 3 in the second direction of rotation F, according to the above actuation phases but in reverse order. One will note that during this movement, the flange 19*b* of the cup 19 participates in guiding the flaps 26 to their closed position.

B. Second Embodiment of the Invention

The second embodiment of the invention, shown in FIGS. 9 to 20, has many points in common with the first embodiment of the invention and will therefore not be fully described below. Only the differences of this second embodiment from the first embodiment described above will be detailed below, it being understood that the advantages already described for the first embodiment are retained in the second embodiment.

As can be seen in FIGS. 9 to 12, the applicator device 101 of the second embodiment comprises a tubular casing 102 which extends along a longitudinal direction X between first and second ends 102*a*, 102*b*, respectively the lower and upper ends. As in the first embodiment, the tubular casing 102 may have a general cylindrical shape centered on a longitudinal axis X, and the second end 102*b* is open.

Figure 13:
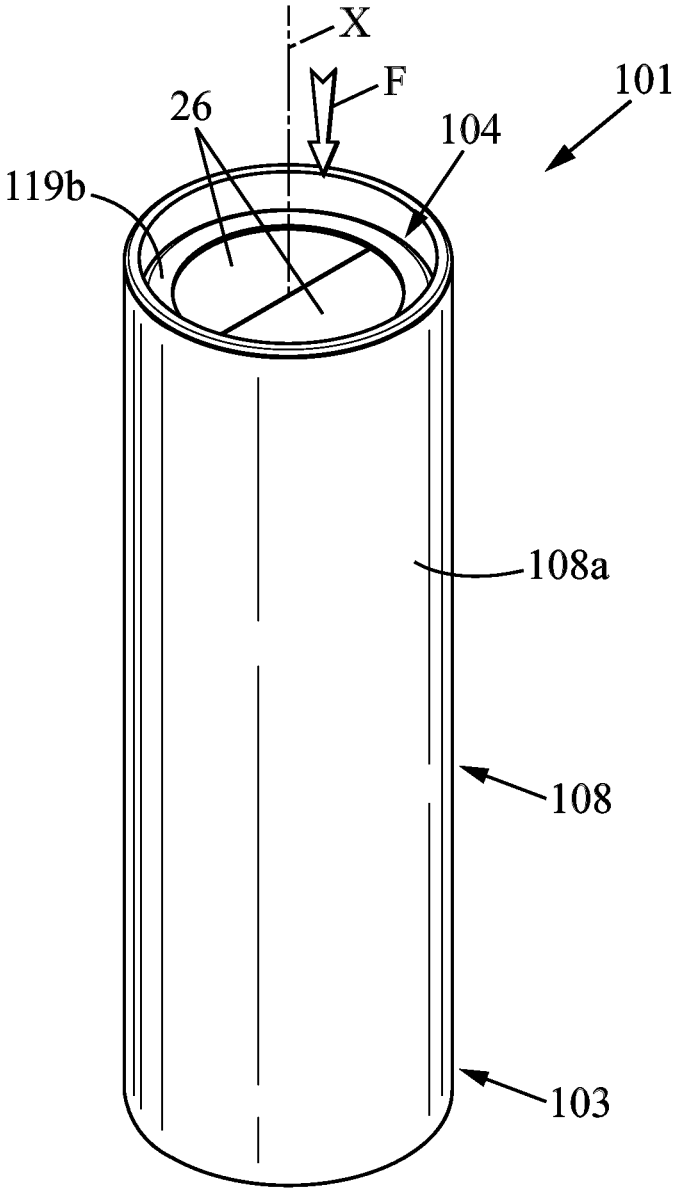

The tubular casing 102 comprises a tubular base 103 extending along the longitudinal axis X and a sleeve 104 mounted so as to rotate freely on the tubular base 103 about the longitudinal axis X, between first and second angular positions respectively corresponding to the storage position (FIG. 1) and the usage position (FIG. 13).

In the storage position, the second end 102*b* of the casing is closed by an end cover 5 identical to the one described above in the first embodiment.

In addition, the tubular casing 102 further contains a maneuvering mechanism 6 identical to the one described above for the first embodiment, making it possible to retract or extend a stick of product 7 that is also identical or similar to the one described above for the first embodiment.

Tubular Base 103

Here the tubular base 103 may, for example, be made of four parts:

- optionally, an outer shell 108 of metal or other material, essentially decorative and similar to the shell 8 of the first embodiment, comprising a tubular side wall 108*a* centered on the longitudinal axis X (for example a surface of revolution about the longitudinal axis X) open at the second end 102*b* of the tubular casing, and closed by a bottom 108*b* at the first end 102*a* of the tubular casing 102,
- a support socket 150 made for example of molded plastic, fitted into the outer shell 108 and secured thereto for example by force fitting or other means,
- a tubular lower sheath 109, made for example of molded plastic and in which the upper portion is similar to the sheath 9 of the first embodiment, this lower sheath 109 being fitted into the support socket 150 and mounted so as to slide therein along the axis X,
- a spring 170, for example a helical compression spring mounted between the support socket 150 and the lower sheath 109.

The support socket 150 has an annular side wall 151, preferably a cylinder centered about the longitudinal axis X, which is fitted into the outer shell 108 and which extends axially between a lower end 151*a* and upper end 151*b*, both open. The lower end 151*a* is extended downwards by four feet 152 extending along the axis X to a base 153 that is integral with said feet 152 and is arranged against the bottom 108*b* of the outer shell 108. The base 153 may possibly comprise a centering pin 154 onto which the lower end of the spring 170 is fitted. The feet 152 project radially inward relative to the side wall 151, for reasons that will be described below.

The support socket 150 further comprises at least one resilient arm 155, and preferably two diametrically opposed resilient arms 155, which extend downward from the lower end 151*a* of the side wall 151, each to a free lower end provided with a pin 155*a* projecting radially inward.

The lower sheath 109 has a tubular side wall centered on the longitudinal axis X (for example a surface of revolution about the longitudinal axis X), fitted into the side wall 151 of the support socket 150. In the example considered here, the side wall of the lower sheath 109 may comprise a thick lower portion 110 and a thinner upper wall 112, separated from the lower wall 110 by an external annular shoulder 111 facing the first end 102*a* of the casing. This upper portion 112 may include an external annular bead 113 adjacent to the external shoulder 111, and at least one external pin 114 (here two diametrically opposite external pins 114) adjacent to the open upper end of the lower socket 109.

The lower sheath 109 may also comprise an internal annular shoulder (not shown), similar to the abovementioned internal annular shoulder 15, formed in the lower portion 110 of the lower sheath and facing the second end 102*b* of the casing, and least one internal helical thread 116 formed in the second portion 12, advantageously two diametrically opposite internal helical threads 16. The helical threads 16 are similar to the abovementioned threads 16 and spiral upward in the first direction of rotation O, each between a lower end and an upper end.

The lower sheath 109 may further comprise:

- at least one axial slot 117 similar to the abovementioned axial slot 17, formed in the lower portion 110 in parallel to the longitudinal axis X, for example extending from the lower end of the lower sheath 109 to near the external annular shoulder 111 (for example two diametrically opposed axial slots 117 in this example),
- and least one arcuate radial slot 118, generally open at one end, formed in the lower portion 110 immediately adjacent to the external shoulder 111 (for example two diametrically opposed slots 18 arranged in the same radial plane, as in this example). The radial slots 118 are similar to the abovementioned radial slots 18. Each of the slots 118 extends angularly between a first end 118*a* and second end 118*b* in the first direction of rotation O, the second angular ends 18*b* of the radial slots 118 respectively opening into the lower ends of the abovementioned threads 116, as explained above for the slots 18 and threads 16 in the first embodiment of the invention.

The lower portion 110 of the lower sheath 109 further includes guide ribs 156 which protrude outward and extend along the longitudinal axis X. Here there are four of these guide ribs 156 and they are divided into two pairs, each pair of guide ribs 156 flanking a pair of arms 155 so as to guide the lower socket 109 as it slides axially within the support socket 150.

The lower end of the lower portion 110 further includes a perforated bottom 157 which bears a cup 158 that is open at the lower end. This cup 158 comprises a side wall 158*a* extending upwardly in the center of the lower portion and closed at its upper end by a bottom 158*b* which may have a centering pin 158*c* at its center. The upper end of the spring 170 may be fitted into the scoop 158 and engaged with the centering pin 158*c*.

The lower portion 110 further comprises at least one cam 159 and preferably two diametrically opposed cams 159 which each receive one of the abovementioned pins 155*a* of the support socket 150.

Each cam 159 has a recess 160 cut into the outer surface of the lower portion 110, for example near its lower end. The sides of this recess 160 are delimited by two lateral edges 161, 162 and the top by an upper edge 163 inclined downward from the upper end of lateral edge 161 to the upper end of lateral edge 162. Also between the lateral edges 161, 162 is a separating rib 164 formed in relief on the recess 160 and extending vertically along a portion of the height of the recess 160, leaving spaces in said recess above and below the separating rib.

Between the separating rib 164 and the lateral edge 161, a first ramp 165 is formed that extends upwards with increasing thickness (therefore increasing upward and radially outward relative to the axis X) to a first flange 166 forming a shoulder facing upwards, then a second ramp 167 which extends upwards with increasing thickness (and therefore increasing upward and radially outward relative to the axis X) to a second flange 168 forming an upwardly facing shoulder. Flange 168 may be substantially parallel to the upper edge 163 of the recess 160 and delimits therewith a guide path 169 that is part of the recess 160. In the storage position of the applicator device 1, the pins 155*a* of the resilient arms 155 are respectively positioned against the second ramps 167, against the flanges 168.

Sleeve 104

As for the sleeve 104, it may for example be made of two parts:

an outer shell 119 of metal or other material, similar to the outer shell 19 of the first embodiment, having a tubular side wall 119*a* centered on the longitudinal axis X (for example a surface of revolution about the longitudinal axis X) and open towards the first end 102*a* of the tubular casing, and an inner annular flange 119*b* at the second end 102*b* of the tubular casing 102, and an upper annular body 120 similar to the upper annular body 20 of the first embodiment, made for example of molded plastic and secured to the outer shell 19, for example by force-fitting or the like.

The upper annular body 120 is centered on the longitudinal axis X and advantageously forms a surface of revolution around this axis. It extends along the axis X between a lower end 120*a* fixed to the lower sheath 109, and an upper end 120*b* positioned under the flange 119*b* of the shell 119.

The upper annular body 120 may have an external annular rib 121 arranged in a plane that is radial relative to the longitudinal axis X, this rib being flush with the outer surface of the shells 108, 119 at their facing ends (upper end of shell 8 and lower end of shell 19).

The upper annular body 120 further comprises at least one axial slot 122 similar to the abovementioned axial slot 22, which extends along the longitudinal axis X and is open at the upper end 120*b* of the upper annular body. Advantageously, the upper annular body 120 comprises two diametrically opposed axial slots 122. At the upper end 120*b* of the upper annular body 120 there may be guides 123 similar to the abovementioned guides 23, formed in relief inside the upper annular body 120 on either side of each slot 122. The respective guides 123 have rounded upper guiding edges 123*a*, each in the form of half a pointed arch, the upper guiding edges 123*a* extending downward (meaning toward the first end 102*a* of the tubular casing) and away from the corresponding slot 122.

The upper annular body 120 further comprises an internal annular groove 124, extending in a radial plane, at its lower end 120*a*. The external annular bead 113 of the lower sheath 109 snap-fits into this internal annular groove 124, so that the upper annular body 120 and the lower sheath 109 are connected so as to be integral in axial translation while allowing relative rotation between these two components about the longitudinal axis X.

The upper annular body 120 further comprises at least one internal guide groove 120*c* (FIGS. 10, 11C) extending along the axis X from the lower end 120*a* to just below one of the guides 123; this guide rib 120*c* is similar to the abovementioned guide rib 20*c* and has the same function. Advantageously, the grooves 120*c* are two in number and are diametrically opposed.

Operation

The applicator device 1 which has just been described operates as follows.

Figure 9:
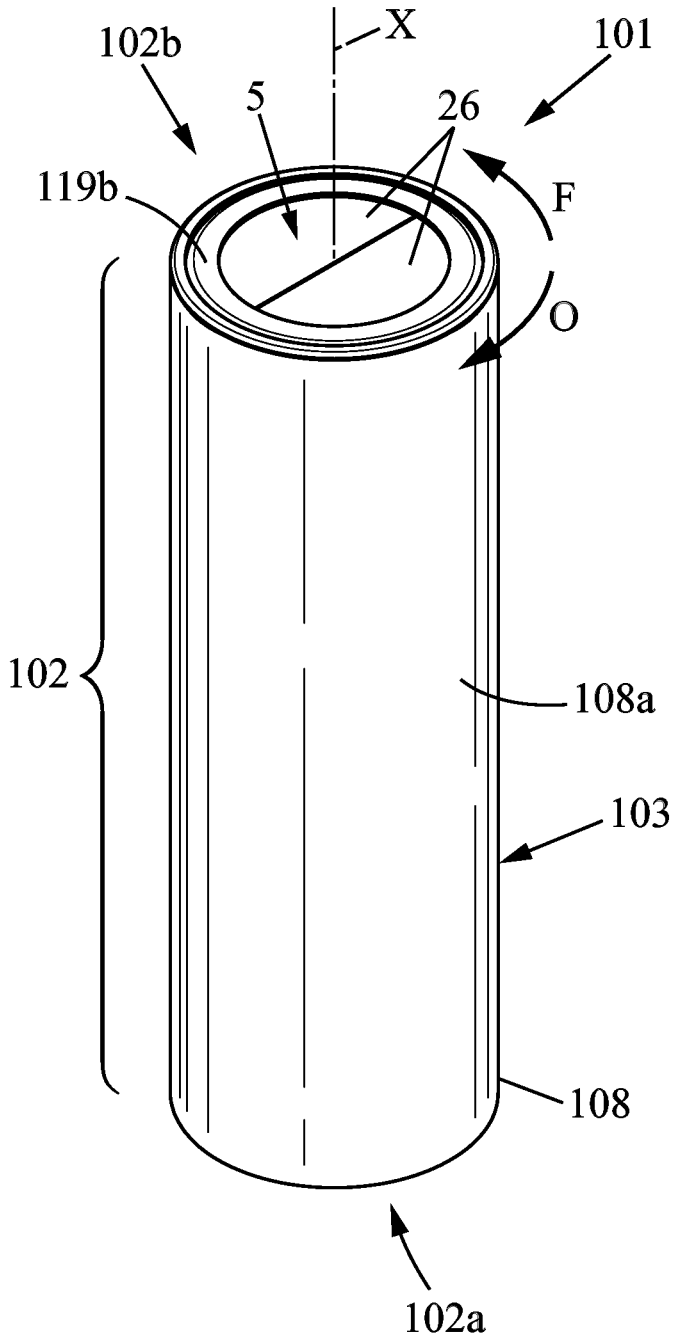
FIG. 9 is a general perspective view of an applicator device according to a second embodiment of the invention, in the storage position.
Figure 10:
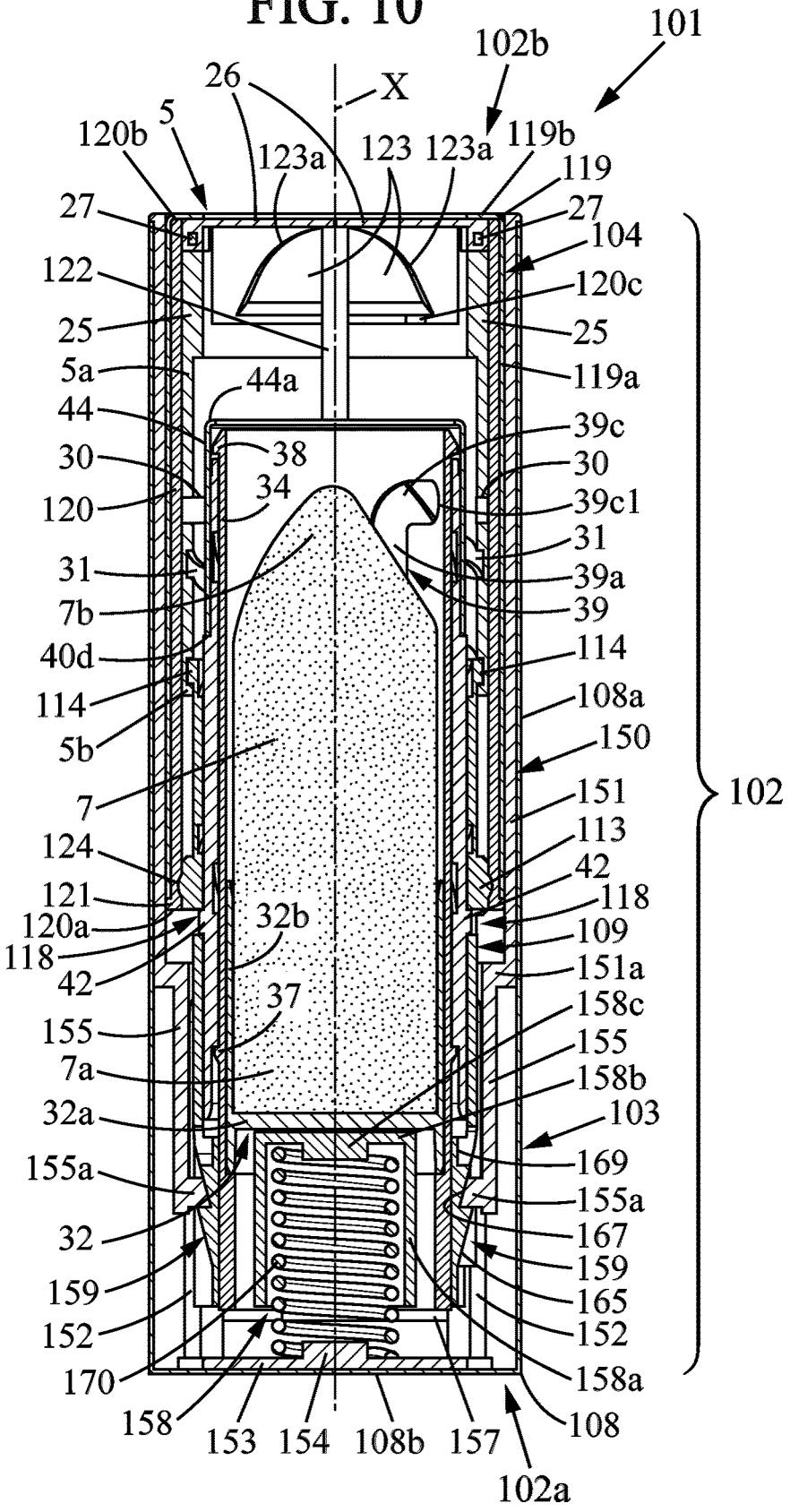
FIG. 10 is an axial sectional view of the applicator device of FIG. 9, FIGS. 11A, 11B and 11C are exploded views of the applicator device of FIG. 9, seen from three different angles.
Figure 11A:
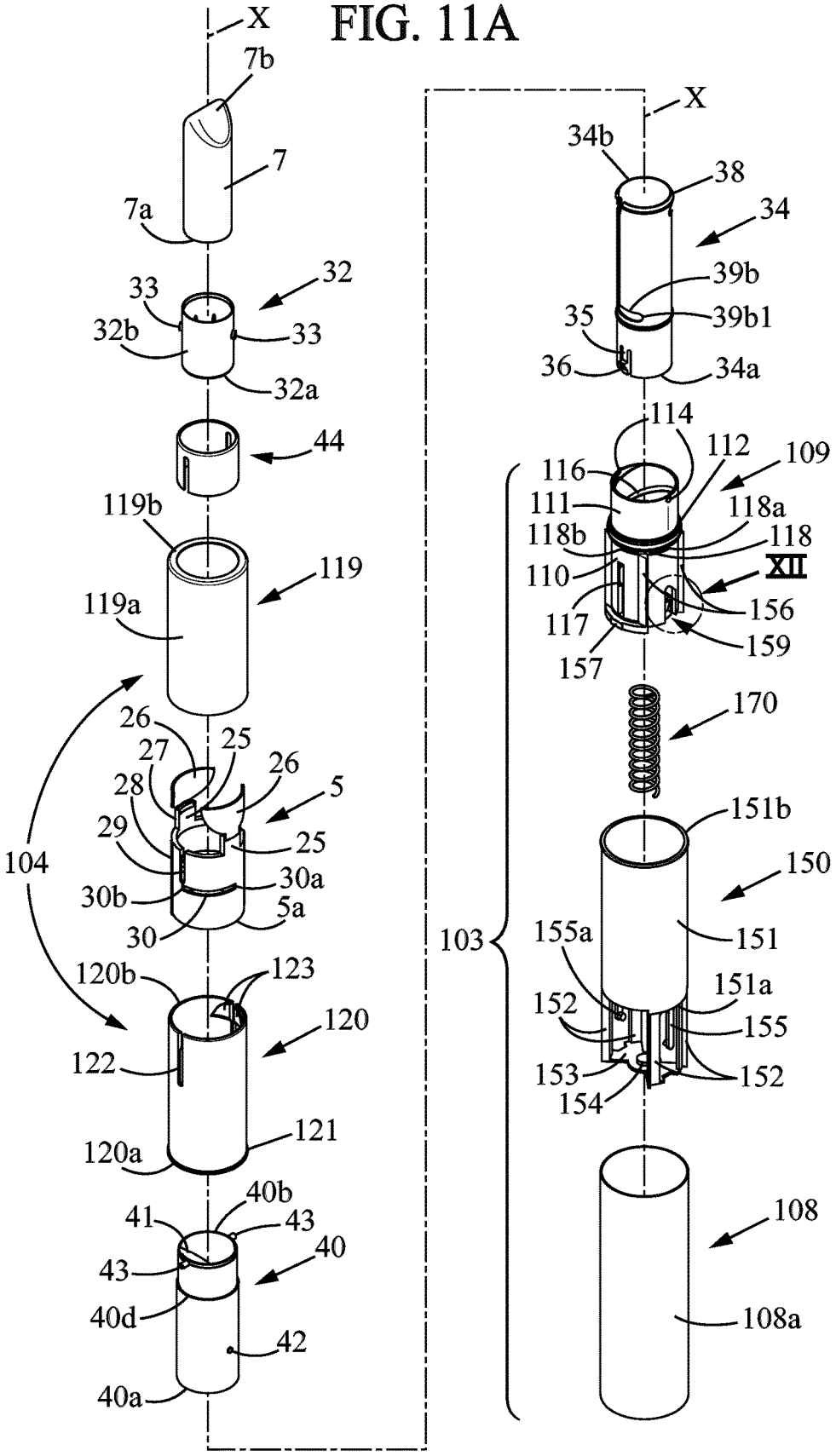
Figure 11B:
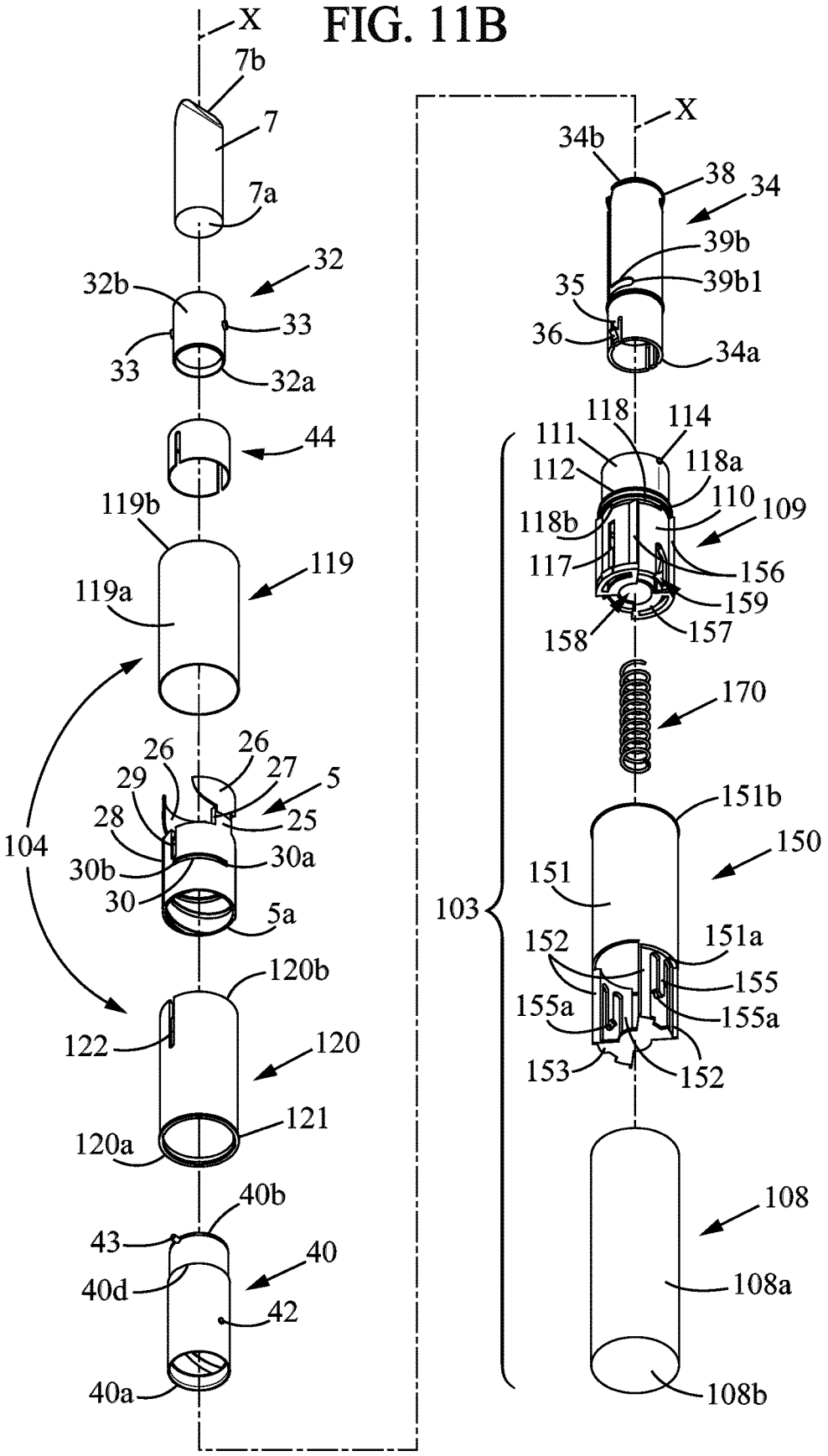
Figure 11C:
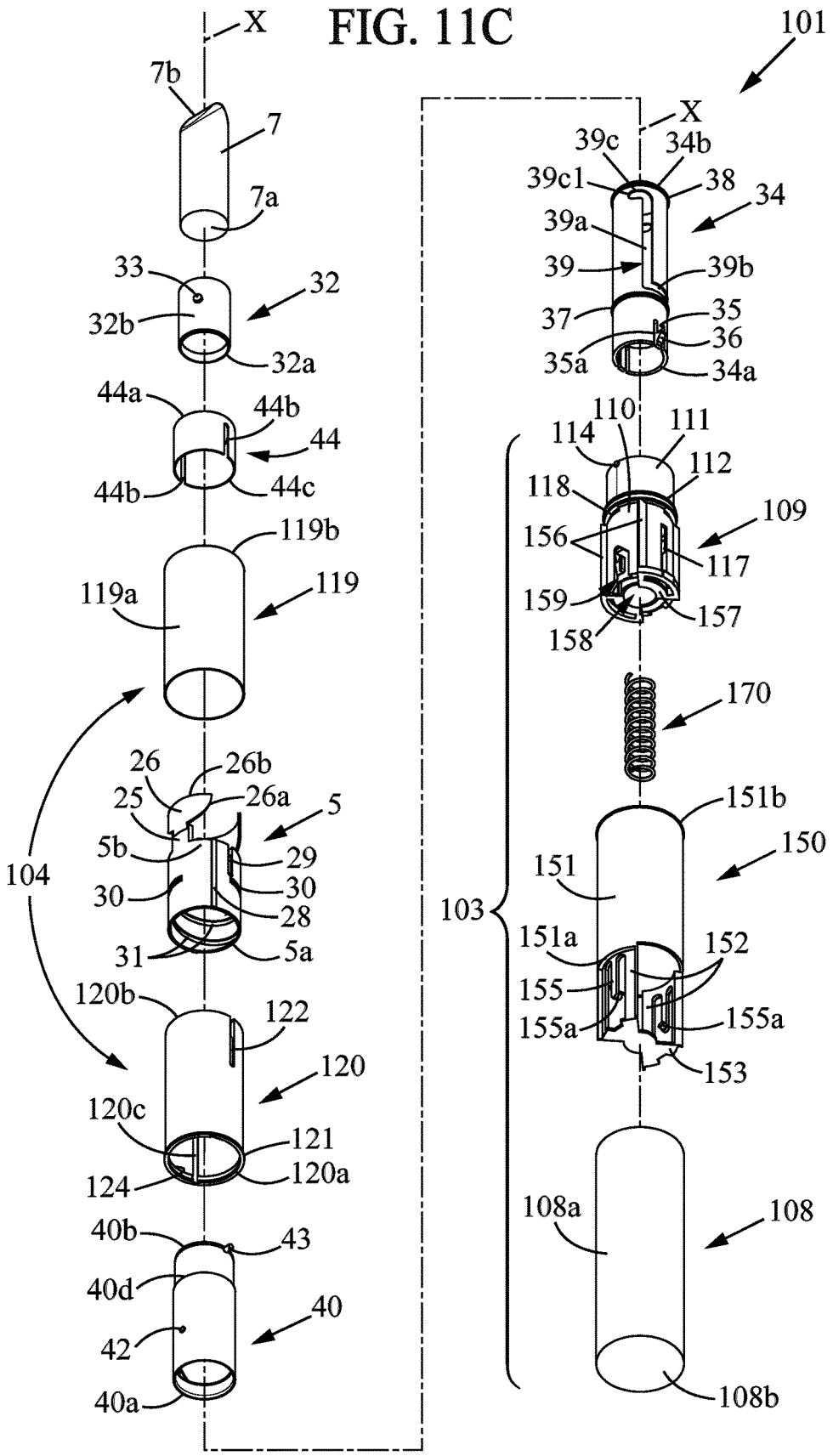
Figure 14:
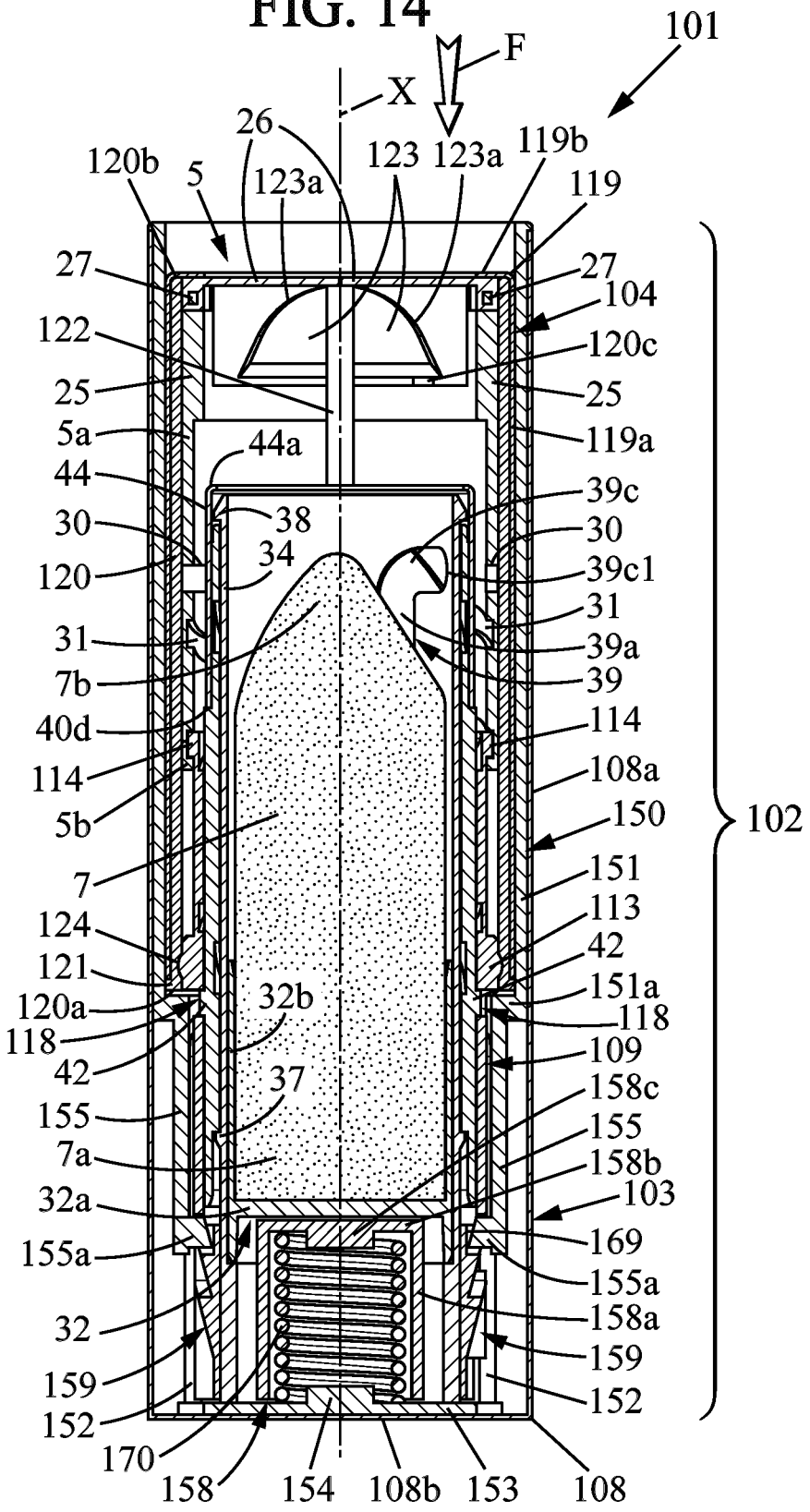

Starting from the storage position of FIGS. 9 and 10, when a user wishes to use the applicator device 101, he or she presses vertically downwards on the upper end of the sleeve 104 in the direction of arrow F in FIGS. 13 and 14. The sleeve 104 then slides downward with the lower sheath 109 relative to the support socket 150, against the resilient bias of the spring 170.

Figure 12:
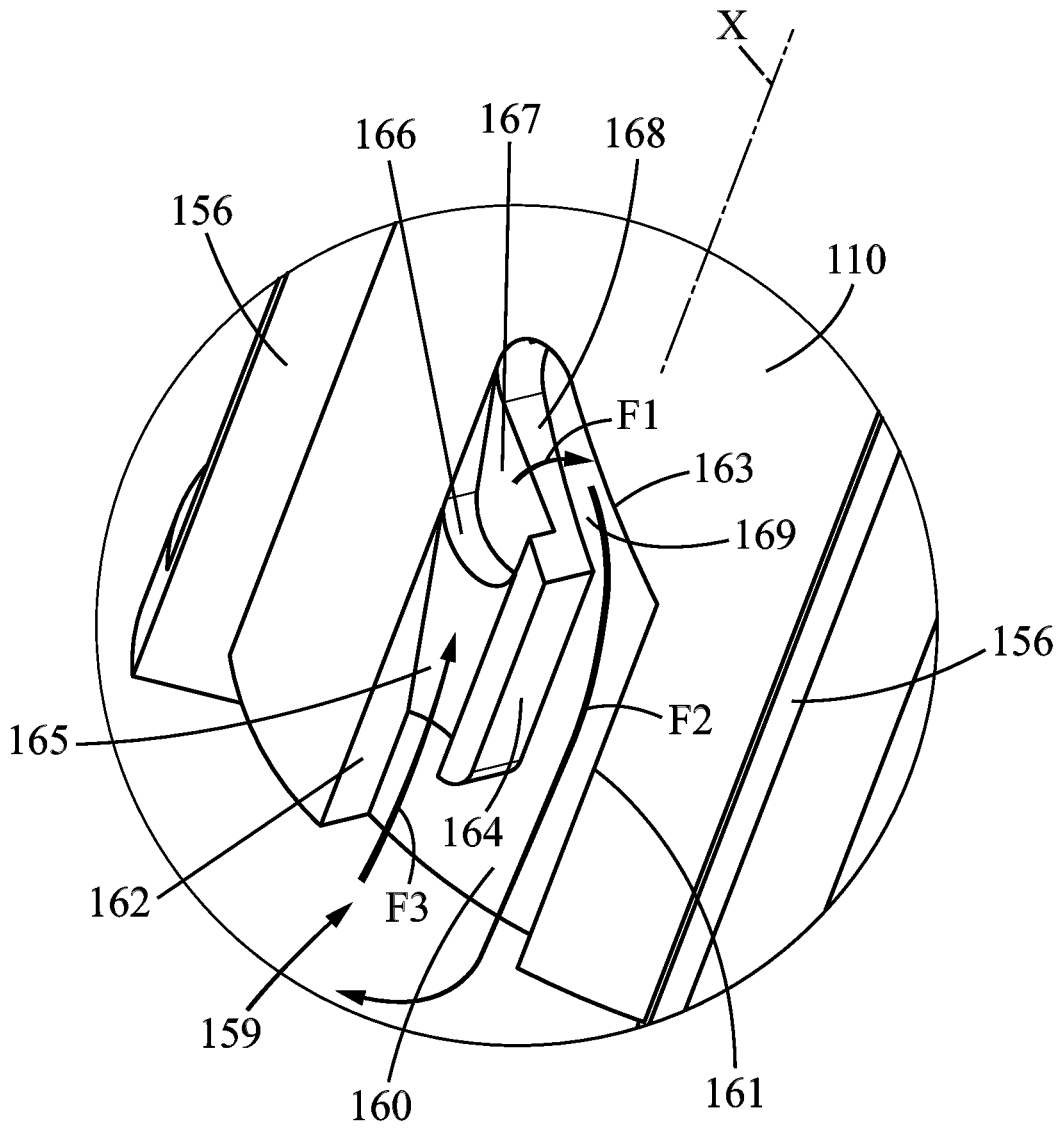
FIG. 12 is a perspective view of detail XII of FIG. 11A, seen from another angle than in FIG. 11A, FIGS. 13 and 14 are views respectively similar to FIGS. 9 and 10, showing the applicator device of FIG. 9 during actuation of the deployment mechanism.

The pins 155*a* of the resilient arms 155 then respectively pass beyond the abovementioned flanges 168 of the cams 159 and reach the guide paths 169 of said cams 159, as indicated by arrow F1 in FIG. 12.

Figure 15:
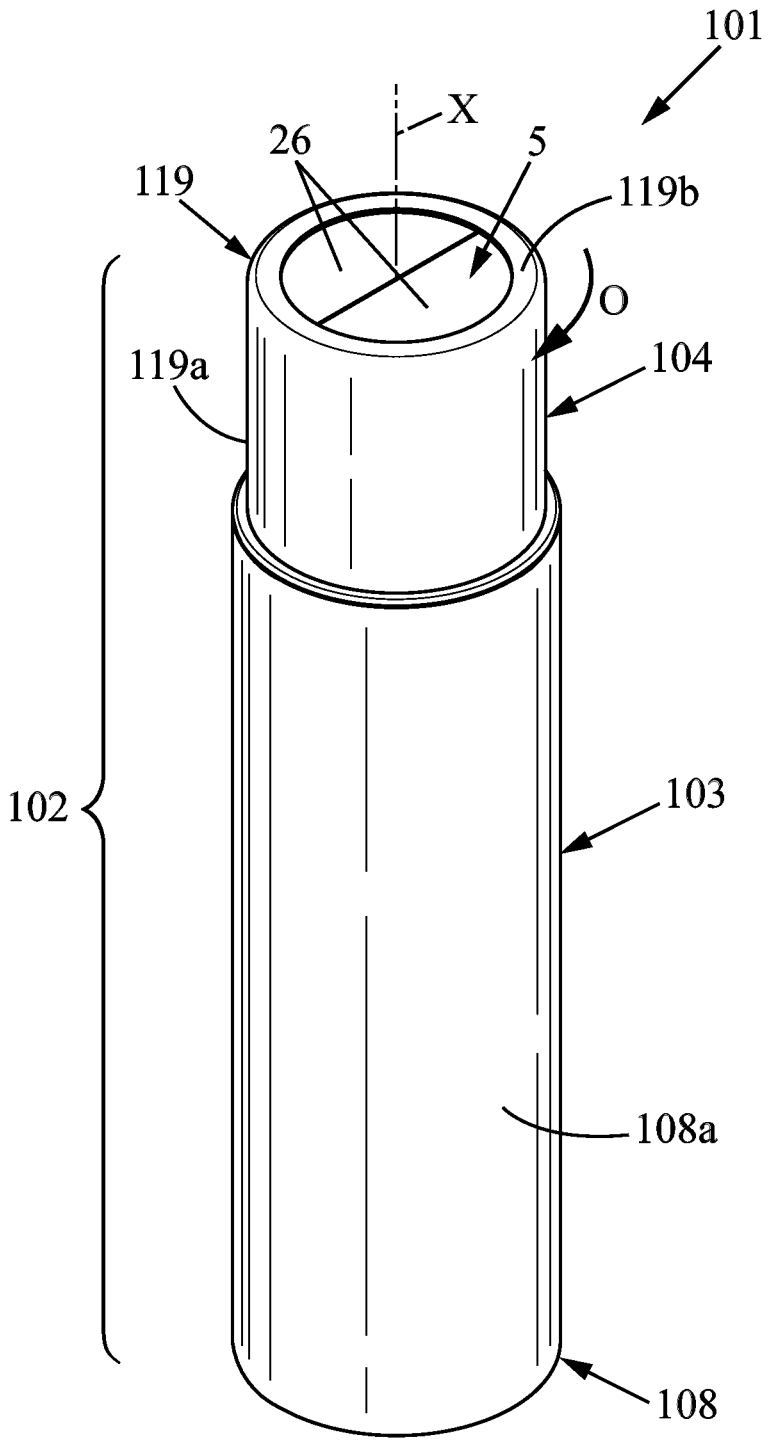
FIGS. 15 and 16 are views respectively similar to FIGS. 9 and 10, showing the applicator device of FIG. 9 in the deployed position, the end cover being closed.
Figure 16:
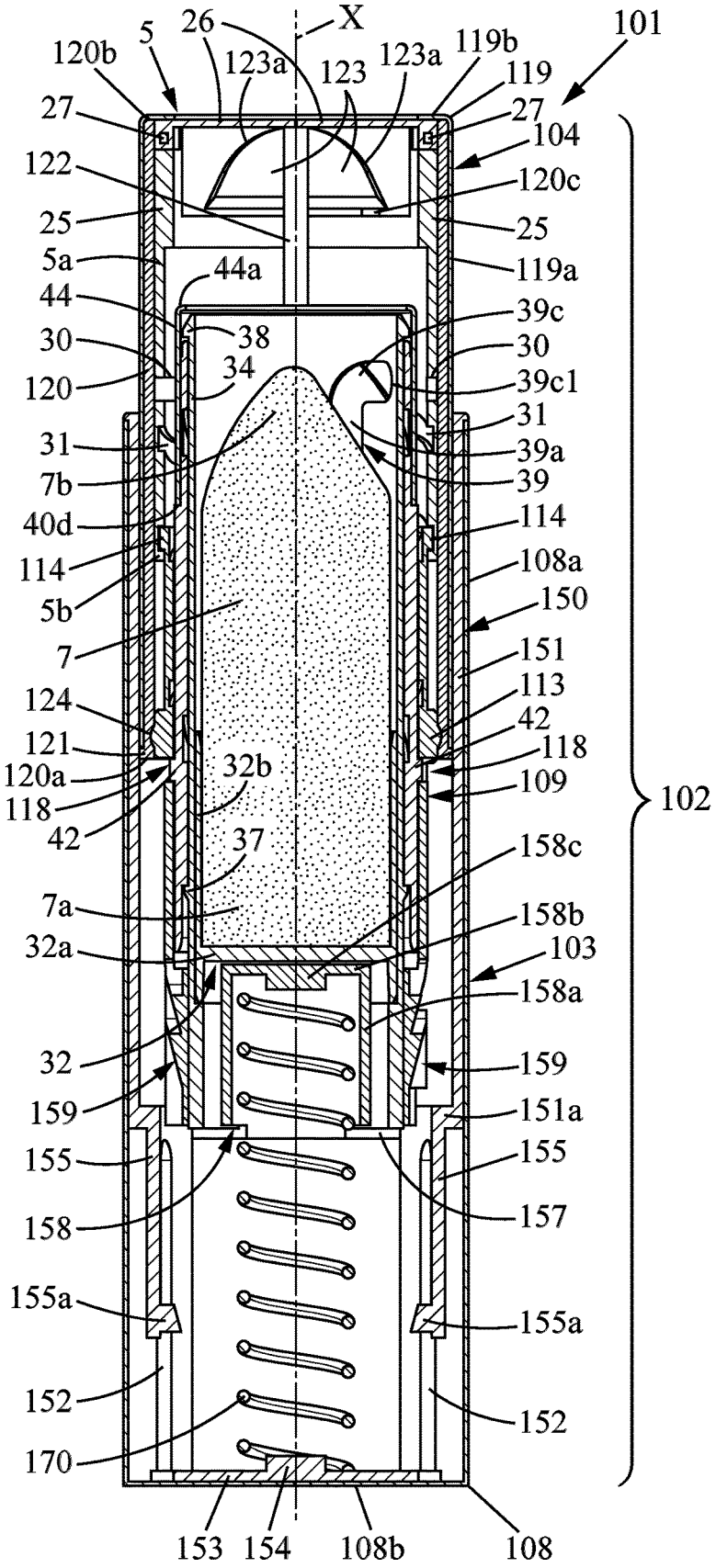
Figure 17:
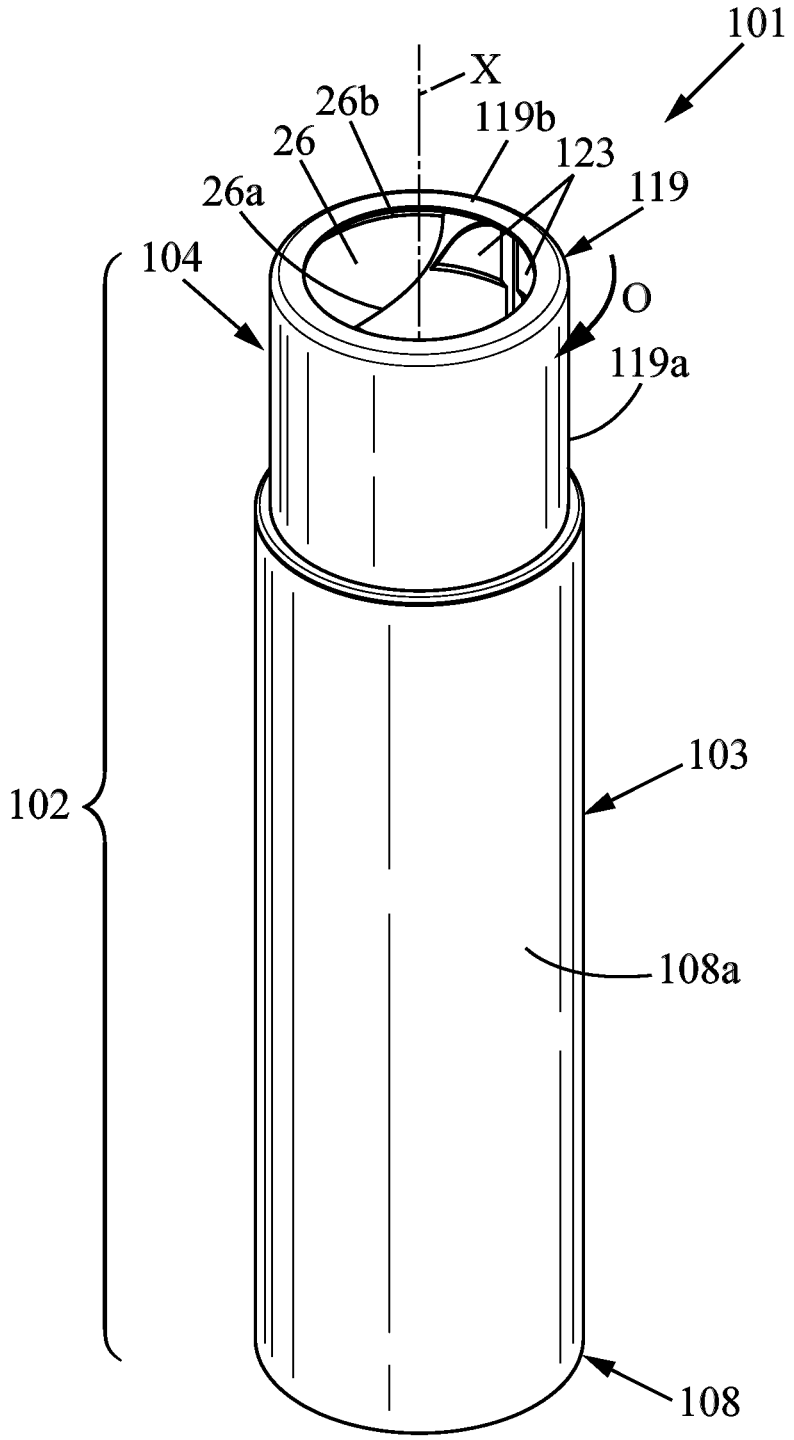
FIGS. 17 and 18 are views respectively similar to FIGS. 9 and 10, showing the applicator device of FIG. 9 with the end cover in the open position, the stick of product being retracted.
Figure 18:
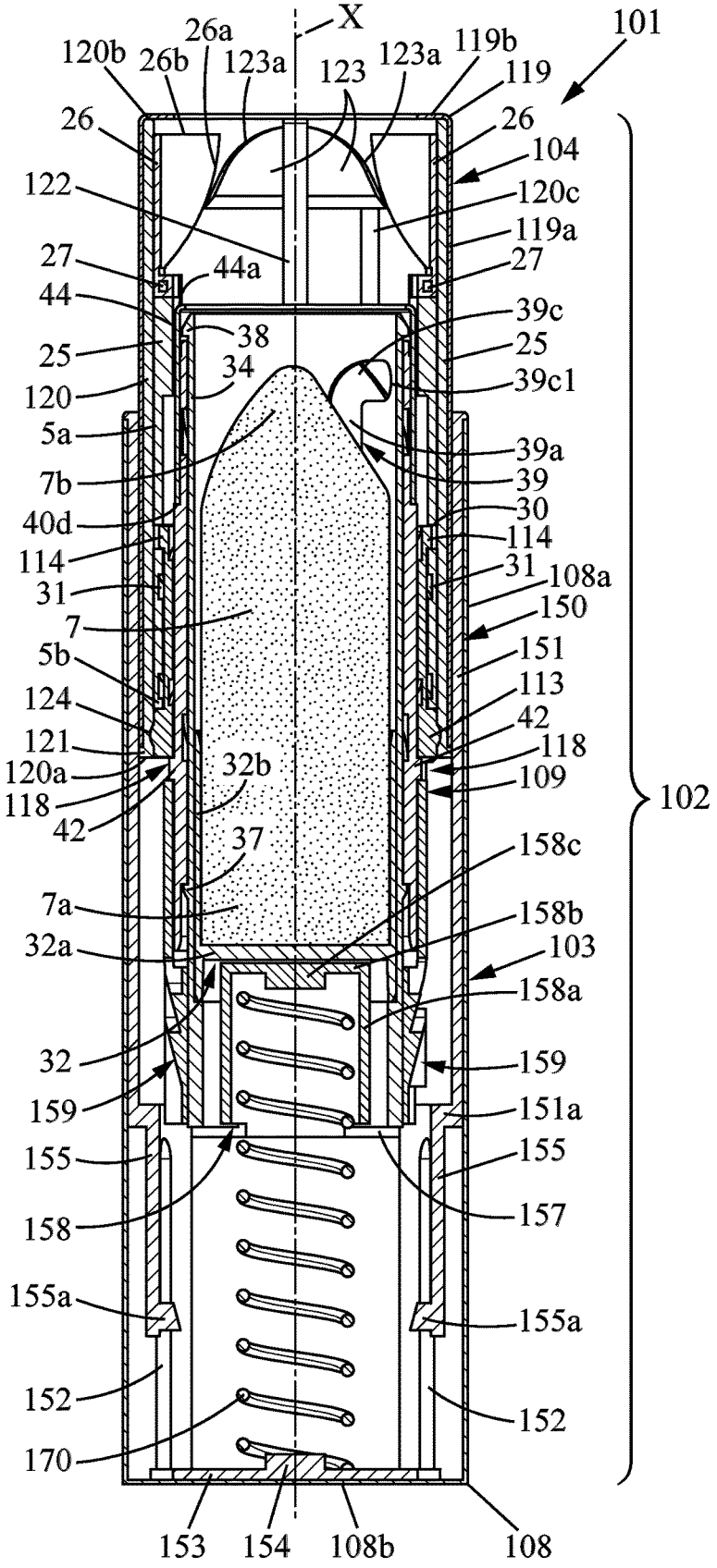
Figure 19:
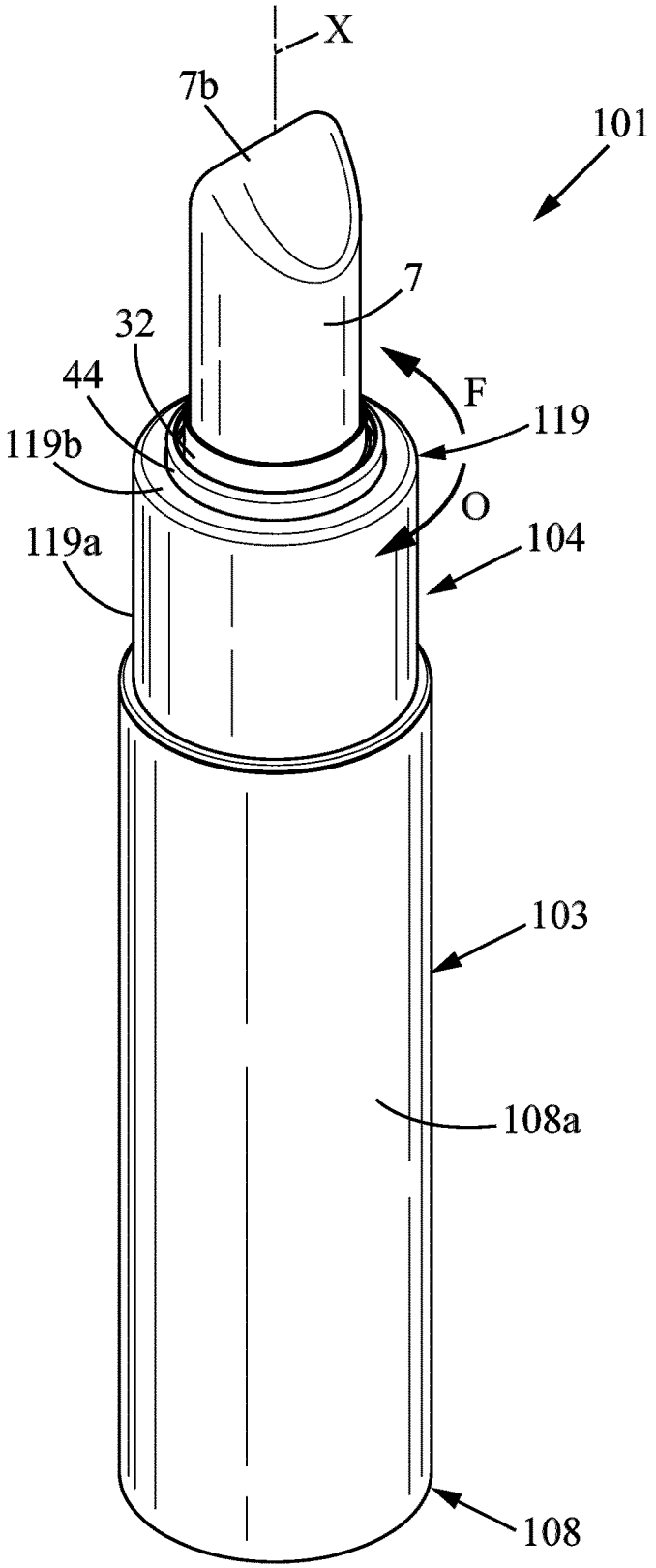
FIGS. 19 and 20 are views respectively similar to FIGS. 9 and 10, showing the applicator device of FIG. 1 in the usage position, the stick of product being extended.
Figure 20:
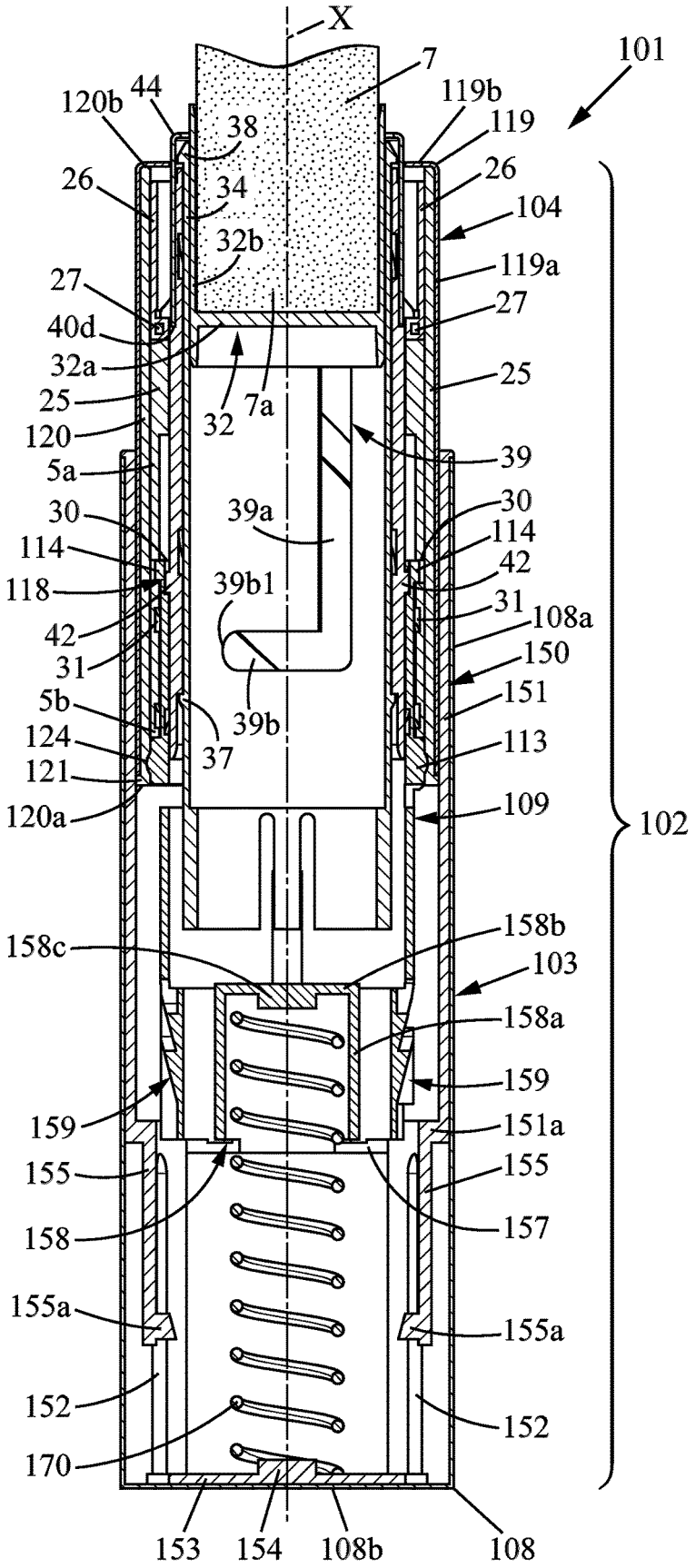

When the user releases pressure on the sleeve 104, said sleeve rises with the lower sheath 109 relative to the support socket 150, under the effect of the spring 170, until the deployed position of FIGS. 15 and 16 is reached, where the sleeve 104 protrudes upward relative to the outer shell 108. During this movement, the pins 155*a* are resiliently displaced laterally along the guide path 169 and then are kept laterally deformed by the separating rib 164 during the raising of the lower sheath 109, then return to the rest position when they are below the level of the separating rib 164, thus returning to a vertical position under the first ramp 165 of the cam 159, below the lower end of the lower sheath 109 (as indicated by arrow F2 in FIG. 12).

From the deployed position of FIGS. 16-16, the user can first open the flaps 26 of the end cover 5 (FIGS. 17-18) and then cause the stick of product 7 to protrude in the usage position (FIGS. 19-20) in the same manner as explained above for the first embodiment, by rotating the sleeve 104 relative to the tubular base 103 in the first direction of rotation O.

After use, the applicator device 101 can be returned to the deployed position by rotating the sleeve 104 relative to the tubular base 103 in the second direction of rotation F, as in the first embodiment.

To return to the storage position, the user simply presses downward again on the sleeve 104, causing it to slide with the lower sheath 109 relative to the support socket 150. The abovementioned pins 155*a* pass respectively beyond the first ramps 165 of the cams 159 then pass beyond the corresponding flanges 166 as indicated by arrow F of FIG. 12. The pins 155*a* thus snap-fit onto the second ramps 167 of the cams 159 and the applicator device 101 is restored to the storage position of FIGS. 9 and 10.

The invention claimed is:

1. An applicator device for a product in stick form, comprising:

a tubular casing extending along a longitudinal axis between first and second ends, the second end being open, said casing being adapted to contain a stick of product and comprising:

a tubular base extending along the longitudinal axis, a sleeve mounted so as to rotate freely on the tubular base about the longitudinal axis, between first and second angular positions, an end cover means adapted to close the second end of the casing and controlled by relative rotation of the sleeve in relation to the base in order to open when said sleeve is rotated in a first direction of rotation relative to the tubular base and to close when said sleeve is rotated in a second direction of rotation that is opposite to the first direction of rotation relative to the tubular base, a maneuvering mechanism having first and second parts mounted so as to rotate relative to one another about the longitudinal axis and a cup for carrying the stick of product, the first and second parts being respectively rotated with the tubular base and with the sleeve and being adapted to move the cup axially relative to said first and second parts toward the second end of the casing when said sleeve is rotated in the first direction of rotation relative to the tubular base and toward the first end of the casing when said sleeve is rotated in the second direction of rotation relative to the tubular base, wherein the first and second parts of the maneuvering mechanism are mounted so as to slide axially relative to the tubular base and to the sleeve respectively, the tubular casing being further connected to one of said first and second parts of the maneuvering mechanism by a guide device suitable for:

moving said first and second parts of the maneuvering mechanism axially toward the second end of the casing when the sleeve is rotated in the first direction of rotation relative to the tubular base from an intermediate angular position between said first and second angular positions, moving said first and second parts of the maneuvering mechanism axially toward the first end of the casing when said sleeve is rotated in the second direction of rotation relative to the tubular base between the second angular position and the intermediate angular position, and not moving said first and second parts of the maneuvering mechanism axially toward the first end of the casing when said sleeve is in an angular position between the first angular position and the intermediate angular position.

2. The applicator device according to claim 1, wherein:

the first and second parts of the maneuvering mechanism are connected so as to be integral in axial translation, the guide device comprises at least one linear guide arranged on a cylindrical surface of revolution centered on the longitudinal axis and at least one follower member sliding along the linear guide, the linear guide and follower member being integrally connected, one to a first element selected from among the first and second parts of the maneuvering mechanism, the other to a second element selected from among the tubular base and the sleeve, the first and second elements not being mounted so as to slide axially relative to one another.

3. The applicator device according to claim 2, wherein said first element is the second part of the maneuvering mechanism and said second element is the tubular base.

4. The applicator device according to claim 2, wherein the linear guide comprises a circular portion comprised within a radial plane and a helical portion, the follower member being located on the circular portion when the sleeve is between the first angular position and the intermediate angular position, and on the helical portion when the sleeve is between the intermediate angular position and the second angular position.

5. The applicator device according to claim 1, wherein the first and second parts of the maneuvering device are rotatably connected respectively to the tubular base and to the sleeve.

6. The applicator device according to claim 1, wherein the maneuvering mechanism further comprises delaying means for delaying an axial sliding of the cup when the sleeve is moved in the first direction of rotation from the first angular position.

7. The applicator device according to claim 6, wherein the first part of the maneuvering mechanism is an inner sheath having at least one slot comprising an axial portion extending between first and second ends respectively located toward the first and second ends of the tubular casing, the slot further comprising an end portion comprised substantially in a radial plane and extending the axial portion in the second direction of rotation at the first end of said axial portion, the second part of the maneuvering mechanism is an outer sheath surrounding the inner sheath and comprising at least one internal helical groove, and the cup comprises at least one pin engaged in both said slot of the inner sheath and said internal groove of the outer sheath, said pin of the cup being in the end portion when the sleeve is in the first angular position.

8. The applicator device according to claim 1, wherein the end cover means comprises a ring housed in the tubular casing, rotatably connected to the sleeve and sliding axially relative to said sleeve, this ring threadably engaging with the tubular base and bearing at least one flap adapted to close the second end of the tubular casing when the sleeve is in the first angular position.

9. The applicator device according to claim 8, wherein the ring bears at least two flexible flaps that are deformable between a planar configuration which closes the second end of the tubular casing and a cylindrical configuration which opens the second end of the tubular casing, the sleeve comprising an inner annular flange at the second end of the tubular casing and the flaps being maintained in a planar configuration by abutment under the inner flange of the sleeve when the sleeve is in the first angular position, the ring being arranged around the maneuvering mechanism and the flaps being held in a cylindrical configuration by cooperation with the tubular casing and maneuvering mechanism when the applicator device is opened.

10. The applicator device according to claim 9, wherein the sleeve further comprises inner guides and the flaps abut against said inner guides when said flaps are in a planar configuration.

11. The applicator device according to claim 10, wherein the flaps are two in number and are in the form of half-disks each comprising a semicircular edge and a straight edge, the semicircular edges being connected to the ring by respective hinges that are diametrically opposed relative to the longitudinal axis, the inner guides each having a guiding edge facing the second end of the tubular casing, each guiding edge having the shape of half a pointed arch having its peak substantially midway between the hinges.

12. The applicator device according to claim 8, wherein the ring is connected to the tubular base by a guide device suitable for moving said ring axially when the sleeve is close to the first angular position and not moving said ring axially when the sleeve is close to the second angular position.

13. The applicator device according claim 1, wherein the sleeve is retractable into the tubular base.

14. The applicator device according to claim 13, wherein the tubular base comprises an outer shell, a support socket fixed in the outer shell, and a sheath on which the sleeve is rotatably mounted, the sheath being mounted so as to slide axially on the support socket between a retracted position where the sleeve is wholly contained in the outer shell, a deployed position where the sleeve protrudes from the outer shell, and an actuation position where the sleeve is pressed into the outer shell toward the first end of the tubular casing relative to the retracted position, the sheath being resiliently biased toward the deployed position and the tubular base having a cam locking device suitable for:

snap-locking the sheath in the retracted position when a user moves said sheath from the deployed position to the retracted position by pressing on the sleeve, and releasing said sheath when a user moves said sheath from the retracted position to the actuation position by pressing on the sleeve.

15. The use of an applicator device according to claim 1, for applying of cosmetics to the lips.

* * * * *